US007527473B2

(12) United States Patent
Humanchuk et al.

(10) Patent No.: US 7,527,473 B2
(45) Date of Patent: May 5, 2009

(54) AIRFOIL SHAPE FOR A TURBINE NOZZLE

(75) Inventors: Craig Humanchuk, Simpsonville, SC (US); Craig Bielek, Simpsonville, SC (US); Linda Farral, Greenville, SC (US); Glen MacMillan, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 407 days.

(21) Appl. No.: 11/586,766

(22) Filed: Oct. 26, 2006

(65) Prior Publication Data

US 2008/0101925 A1 May 1, 2008

(51) Int. Cl.
*F01D 9/04* (2006.01)

(52) U.S. Cl. ..... 415/191; 415/193; 415/208.2; 415/209.1; 415/210.1; 415/211.2

(58) Field of Classification Search ..... 415/191, 415/193, 208.1, 208.2, 209.1, 209.4, 210.1, 415/211.2; 416/223 R, 223 A, 243, DIG. 2, 416/DIG. 5

See application file for complete search history.

(56) References Cited

U.S. PATENT DOCUMENTS 5,980,209 A 11/1999 Barry
6,398,489 B1 * 6/2002 Burdgick et al. ..... 415/115
6,722,851 B1 * 4/2004 Brittingham et al. ..... 416/96 R
6,736,599 B1 * 5/2004 Jacks et al. ..... 415/191
6,832,897 B2 * 12/2004 Urban ..... 416/223 A
7,329,093 B2 * 2/2008 Vandeputte et al. ..... 415/191
7,351,038 B2 * 4/2008 Girgis et al. ..... 416/223 A
7,367,779 B2 * 5/2008 Girgis et al. ..... 416/223 A
7,467,920 B2 * 12/2008 Sullivan et al. ..... 415/193
2008/0056893 A1 * 3/2008 Marini et al. ..... 415/191
2008/0056902 A1 * 3/2008 Ravanis et al. ..... 416/223 R

* cited by examiner

*Primary Examiner*—Christopher Verdier
(74) *Attorney, Agent, or Firm*—Edward J. Smith; Ernest G. Cusick; Frank A. Landgraff

(57) ABSTRACT

The first stage nozzles have airfoil profiles substantially in accordance with Cartesian coordinate values of X, Y and Z set forth Table I. The X and Y values are in inches and the Z value is in inches along the nozzle stacking axis coincident with a turbine radius. The X and Y distances may be scalable as a function of the same constant or number to provide a scaled up or scaled down airfoil section for the nozzle. The nominal airfoil given by the X, Y and Z distances lies within an envelope of±0.160 inches.

15 Claims, 5 Drawing Sheets

AIRFOIL SHAPE FOR A TURBINE NOZZLE

BACKGROUND OF THE INVENTION

The present invention relates to a turbine nozzle for a gas turbine and particularly relates to a first stage turbine nozzle airfoil profile.

In a gas turbine, many system requirements should be met at each stage of a gas turbine's flow path section to meet design goals. These design goals include, but are not limited to, overall improved efficiency and airfoil loading capability. For example, and in no way limiting of the invention, a nozzle of a turbine should achieve thermal and mechanical operating requirements for that particular stage.

Airfoil points have been patented as demonstrated by Barry et al. in U.S. Pat. No. 5,980,209. Barry et al. identified from 100-150 points per section with each section at a spacing of 0.52", a stagger angle vs. radius, a throat angle vs. radius and a camber vs. radius. The number of points defined is dependent upon the rate of change of curvature of the section. In other words, for areas with higher curvature more points are used to define that region.

BRIEF DESCRIPTION OF THE INVENTION

In accordance with one aspect of the present invention, there is provided a turbine nozzle having an airfoil shape in an envelope within ±0.160 inches in a direction normal to any airfoil surface location wherein the airfoil has a nominal profile substantially in accordance with Cartesian coordinate values of X, Y and Z set forth in Table I. X and Y are distances in inches defining the airfoil profile at each distance Z, the profiles at the Z distances being joined smoothly with one another to form a complete airfoil shape.

In accordance with another aspect of the present invention, there is provided a turbine nozzle having an uncoated nominal airfoil profile substantially in accordance with Cartesian coordinate values of X, Y and Z set forth in Table I. X and Y are distances in inches defining the airfoil profile at each distance Z. The profiles at the Z distances are joined smoothly with one another to form a complete airfoil shape. The X and Y distances are scalable as a function of the same constant or number to provide a scaled-up or scaled-down nozzle airfoil.

In a further aspect of the present invention, there is provided a turbine with a nozzle arrangement having a plurality of nozzles. Each nozzle includes an airfoil having an uncoated nominal airfoil profile substantially in accordance with Cartesian coordinate values of X, Y, and Z set forth in Table I. X and Y are distances in inches which, when connected by smooth continuing arcs, define airfoil profile sections at each distance Z in inches. The profile sections at the Z distance are joined smoothly with one another to form a complete airfoil shape.

DETAILED DESCRIPTION OF THE INVENTION

The embodiments of the present invention have many advantages, including defining airfoils for nozzles satisfying the restrictive thermal and mechanical operating requirements for that particular stage that a nozzle of a turbine should achieve.

In accordance with one aspect of the present invention, a unique airfoil profile is provided for the nozzles of a turbine stage, preferably the first stage of a gas turbine. The nozzle airfoil profile is defined by a unique loci of points to achieve the necessary efficiency whereby improved turbine performance is obtained. These unique loci of points define the nominal airfoil profile and are identified by the X, Y and Z Cartesian coordinates of Table I. The 1387 points for the coordinate values provided in Table I are for a cold (i.e., room temperature) profile at various planar cross-sections of the nozzle airfoil along its length. The X and Y coordinates are given in distance dimensions, e.g., units of inches, and are joined smoothly at each Z location to form a smooth continuous airfoil cross-section. The Z coordinates are given in length dimension of inches along a nozzle stacking axis coincident with a radius from the axis of turbine rotation. Each defined cross-section is then joined smoothly with adjacent cross-sections to form the complete airfoil shape.

It will be appreciated that as each nozzle airfoil heats up in use, the profile will change as a result of stress and temperature. Thus, the cold or room temperature profile is given by the X, Y and Z coordinates for manufacturing purposes. Since the manufactured nozzle airfoil profile may be different from the nominal airfoil profile given by the following table, a distance of plus or minus 0.160 inches from the nominal profile in a direction normal to any airfoil surface location along the nominal defines the profile envelope for this nozzle airfoil. The envelope includes any possible airfoil surface coating process. The design is robust to this variation without impairment of the mechanical and aerodynamic functions.

It will also be appreciated that the airfoil can be scaled up or scaled down geometrically for introduction into similar turbine designs. Consequently, the X, Y, and Z coordinates in inches of the nominal airfoil profile given below are a function of the same constant or number. That is, the X and Y and optionally the Z coordinate values in inches may be multiplied or divided by the same constant or number to provide a scaled up or scaled down version of the nozzle airfoil profile while retaining the airfoil section shape.

Figure 1:
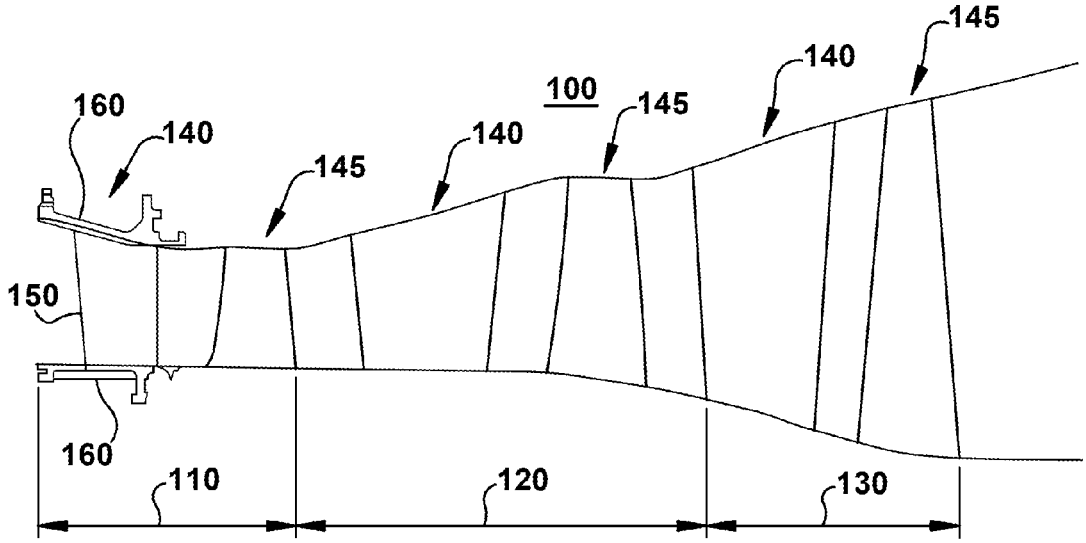
FIG. 1 schematically illustrates a turbine having a first stage turbine nozzle arrangement employing the nozzles and nozzle airfoils.

FIG. 1 schematically illustrates an exemplary turbine having a first stage turbine nozzle arrangement employing nozzles and nozzle airfoils. The turbine 100 includes a first stage 110, a second stage 120 and third stage 130. Each stage includes a nozzle arrangement 140 in conjunction with respective buckets 145 of the various stages of a rotor. It will be appreciated that a three stage turbine is illustrated, however, turbines come in many different configurations of and numbers of stages, nozzle arrangements, and buckets.

The nozzles are suitably mounted on the surrounding hardware by means not shown. The airfoil 150 and sidewalls 160 are collectively referred to as a nozzle. The airfoil has a profile including a 3-dimensional shape with suction and pressure sides, respectively, as well as a leading edge and trailing edge.

The first stage includes a single airfoil nozzle arrangement and rotor assembly whereby the nozzles 140 are upstream of the buckets 145. It will be appreciated that a plurality of the nozzles are spaced circumferentially, one from the other, about the first stage nozzle arrangement and in this instance there are forty eight (48) nozzles mounted on the first stage nozzle arrangement.

Figure 2:
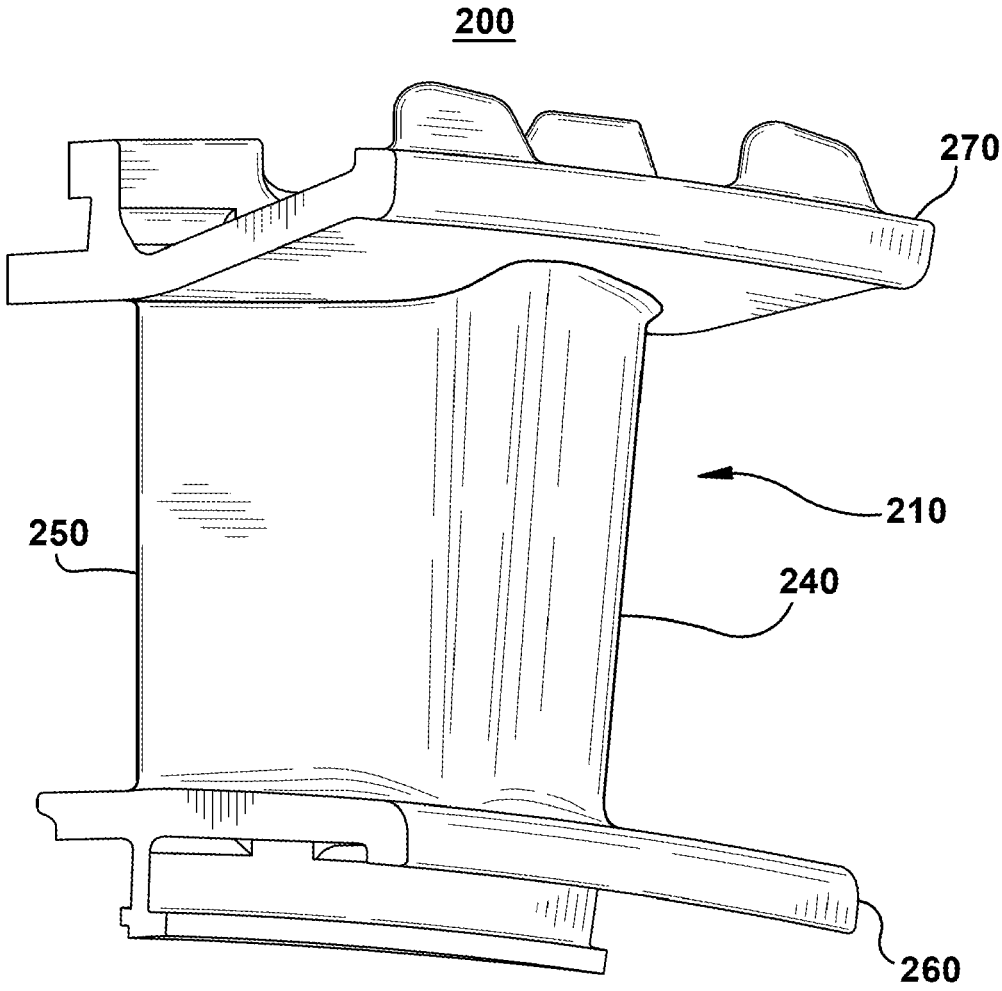
FIG. 2 illustrates a frontal view of a first stage turbine nozzle including an airfoil and sidewalls in accordance with a preferred embodiment of the present invention.
Figure 3:
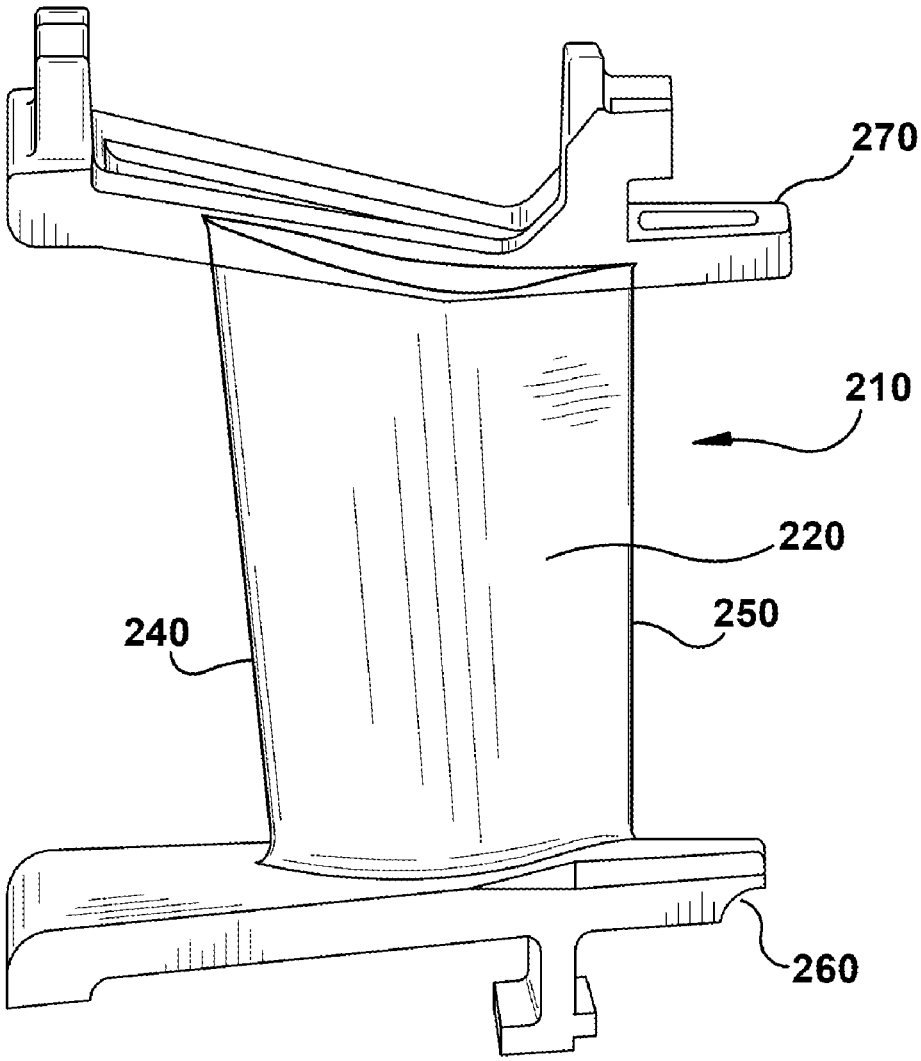
FIG. 3 illustrates a suction side view of a first stage turbine nozzle including an airfoil and sidewalls in accordance with a preferred embodiment of the present invention.
Figure 4:
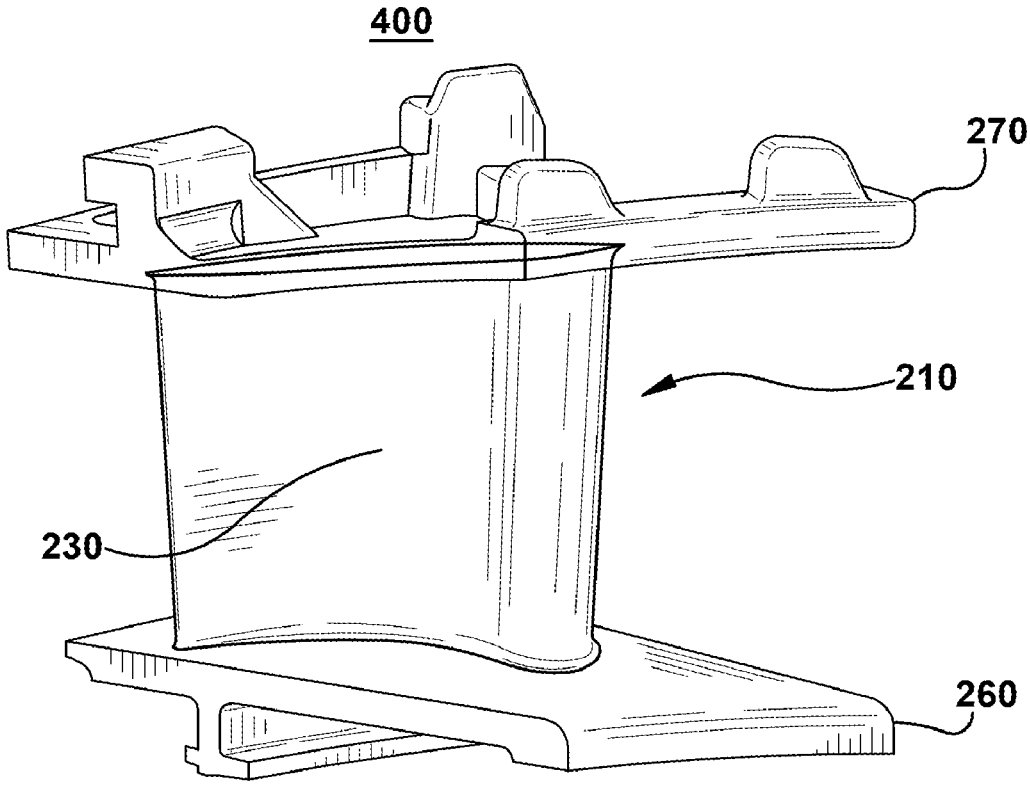
FIG. 4 illustrates a pressure side isometric view of a first stage turbine nozzle including an airfoil and sidewalls in accordance with a preferred embodiment of the present invention.

Referring now to FIGS. 2, 3, and 4, there is illustrated a first stage turbine nozzle constructed in accordance with one aspect of the present invention including an airfoil mounted between an inner and an outer sidewall. Fillets are not included in point definition.

FIG. 2 illustrates a frontal view of an exemplary first stage turbine nozzle 200 including an airfoil 210, an inner sidewall 260, and the outer sidewall 270 in accordance with one aspect of the present invention. A leading edge 240 and a trailing edge 250 for the airfoil 210 are identified.

FIG. 3 illustrates a suction side view of the exemplary first stage turbine nozzle 200 including the airfoil 210, the inner sidewall 260 and the outer sidewall 270 in accordance with an aspect of the present invention. The suction side 220, the leading edge 240 and the trailing edge 250 of the airfoil 210 are identified.

FIG. 4 illustrates a pressure side isometric view of a first stage turbine nozzle 200 including the airfoil 210 and the inner sidewall 260 and the outer sidewall 270 in accordance with an aspect of the present invention. The pressure side 230, the leading edge 240 and the trailing edge 250 of the airfoil 210 are identified.

Figure 5:
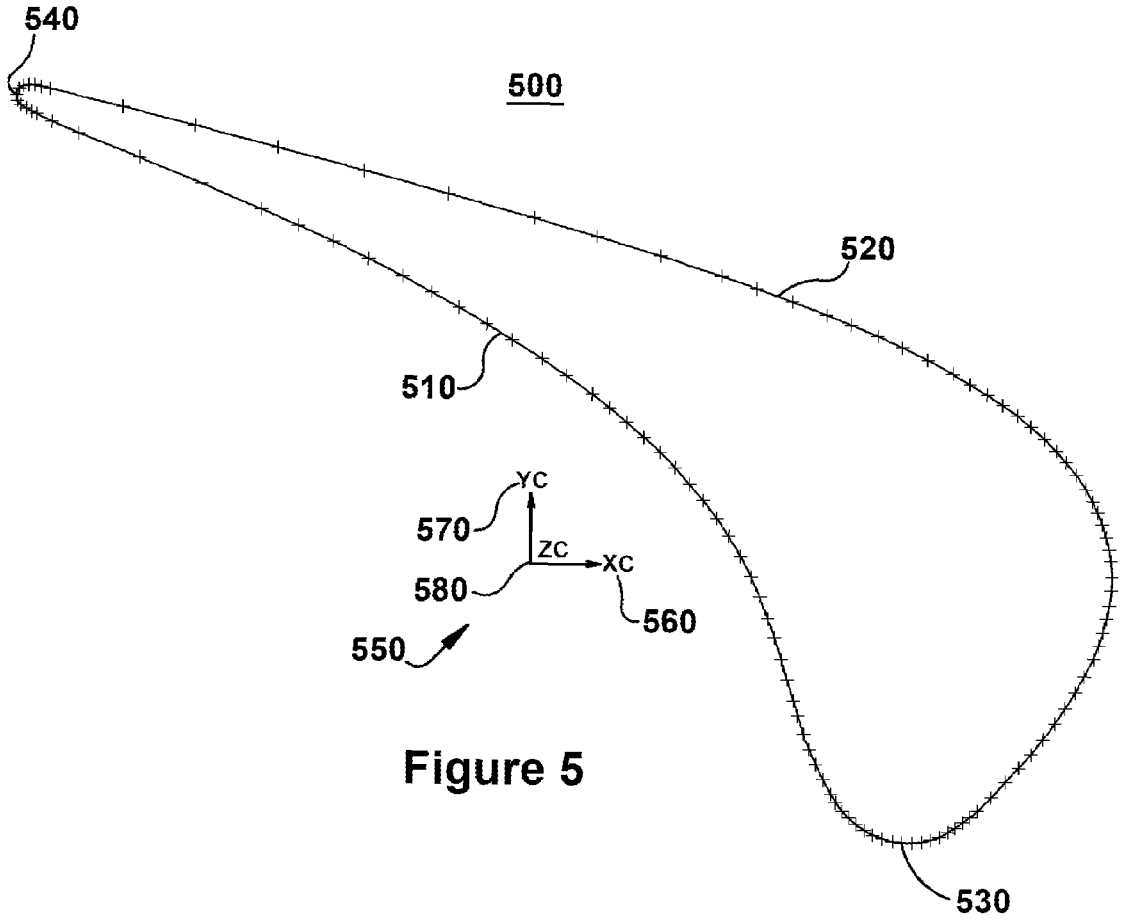
FIG. 5 illustrates a typical section through the airfoil including point coordinates with respect to the coordinate system orientation.

FIG. 5 illustrates a typical section through the airfoil, including point coordinates with respect to a coordinate system orientation. A typical section 500 through the airfoil, including a pressure side 510, a suction side 520, a leading edge 530 and a trailing edge 540, are identified. FIG. 5 also shows the typical distribution of coordinate points for a section taken from Table 1. The points are defined such that a greater concentration of points represent the areas in which the rate of change of the curvature is greater as seen at the leading edge 530 and trailing edge 540. This captures the true intent and criticality of the airfoil shape for operation.

A Cartesian coordinate system 550 of X, Y and Z values given in Table I defines the profile of nozzle airfoil. The coordinate values for the X, Y, and Z coordinates are set forth in inches in Table I although other units of dimensions may be used. The Cartesian coordinate system has orthogonally-related X, Y and Z axes with the Z axis extending perpendicular to a plane normal to a plane containing the X and Y values. The Z distance commences at 0 at the turbine centerline. The Y axis lies parallel to the turbine rotor centerline, i.e., the rotary axis. The X, Y and Z axes for the Cartesian coordinate system 550 are represented in FIG. 5 as XC 560, YC 570 and ZC 580.

By defining X and Y coordinate values at selected locations in a Z direction normal to the X, Y plane, the profile of the airfoil can be ascertained. By connecting the X and Y values with smooth continuing arcs, each profile section at each distance Z is fixed. The surface profiles of the various surface locations between the distances Z are determined by smoothly connecting the adjacent cross-sections to one another to form the airfoil surface. These values represent the airfoil profiles at ambient, non-operating or non-hot conditions and are for an uncoated airfoil. The sign convention assigns a positive value to Z values and positive and negative values for the X and Y coordinates as typically used in Cartesian coordinate systems.

The Table I values are generated and shown for determining the profile of the airfoil. There are typical manufacturing tolerances, as well as coatings, which must be accounted for in the actual profile of the airfoil. Accordingly, the values for the profile given in Table I are for a nominal airfoil. It will therefore be appreciated that ±typical manufacturing tolerances, i.e. ±values, including any coating thicknesses, are additive to the X and Y values given in Table I below. Accordingly, a distance of ±0.160 inches in a direction normal to any surface location along the airfoil profile defines an airfoil profile envelope for this particular nozzle airfoil design and turbine.

TABLE 1

The coordinate values given below provide the preferred nominal profile envelope information regarding the XYZ coordinates which are optimized for the 1st stage nozzle of a 7FB integrated gasification combined cycle (IGCC) gas turbine by the General Electric Company.

| X | Y | Z |
|---|---|---|
| 4.7328 | −3.8081 | 41.17 |
| 5.8501 | −2.5953 | 41.17 |
| 4.9731 | −3.7668 | 41.17 |
| 4.1862 | −3.1397 | 41.17 |
| 4.6859 | −3.8006 | 41.17 |
| 5.1804 | −3.6101 | 41.17 |
| 4.3477 | −3.5342 | 41.17 |
| 5.565 | −3.1712 | 41.17 |
| 4.4065 | −3.6227 | 41.17 |
| 5.7466 | −1.9003 | 41.17 |
| 4.2202 | −3.2462 | 41.17 |
| 4.7802 | −3.8106 | 41.17 |
| 5.8051 | −2.7404 | 41.17 |
| 5.1037 | −3.6812 | 41.17 |
| 5.3978 | −3.3777 | 41.17 |
| 5.8088 | −2.0246 | 41.17 |
| 4.3221 | −3.4874 | 41.17 |
| 4.3755 | −3.5795 | 41.17 |
| 5.6247 | −3.0855 | 41.17 |
| 4.8745 | −3.8003 | 41.17 |
| 4.5848 | −3.7664 | 41.17 |
| 5.7762 | −2.811 | 41.17 |
| 5.019 | −3.7423 | 41.17 |
| 5.7309 | −2.9055 | 41.17 |
| 4.8276 | −3.8079 | 41.17 |
| 5.877 | −2.3699 | 41.17 |
| 5.0624 | −3.7134 | 41.17 |
| 4.4412 | −3.6627 | 41.17 |
| 5.3081 | −3.4759 | 41.17 |
| 4.2566 | −3.344 | 41.17 |
| 5.8328 | −2.0897 | 41.17 |
| 4.1556 | −3.0322 | 41.17 |
| 5.7799 | −1.9614 | 41.17 |
| 5.8653 | −2.2248 | 41.17 |
| 4.9248 | −3.7863 | 41.17 |
| 4.2985 | −3.4396 | 41.17 |
| 5.8517 | −2.1566 | 41.17 |
| 4.64 | −3.7883 | 41.17 |
| 5.6985 | −1.8257 | 41.17 |
| 5.8299 | −2.6685 | 41.17 |
| 5.8738 | −2.2939 | 41.17 |
| 5.1429 | −3.6465 | 41.17 |
| 5.6447 | −1.755 | 41.17 |
| 5.6802 | −2.9969 | 41.17 |
| 5.2169 | −3.5728 | 41.17 |
| 5.4838 | −3.2764 | 41.17 |
| 5.8741 | −2.4457 | 41.17 |
| 4.4848 | −3.7029 | 41.17 |
| 5.865 | −2.521 | 41.17 |
| 4.5328 | −3.7377 | 41.17 |
| 5.2994 | −1.4455 | 41.17 |
| 4.6639 | −1.1048 | 41.17 |
| 3.8357 | −2.1907 | 41.17 |
| 4.066 | −2.7092 | 41.17 |
| 4.0311 | −2.603 | 41.17 |
| 5.0174 | −1.273 | 41.17 |

TABLE 1-continued

The coordinate values given below provide the preferred nominal profile envelope information regarding the XYZ coordinates which are optimized for the 1st stage nozzle of a 7FB integrated gasification combined cycle (IGCC) gas turbine by the General Electric Company.

| X | Y | Z |
|---|---|---|
| 3.9918 | −2.4984 | 41.17 |
| 3.8948 | −2.2916 | 41.17 |
| 3.5438 | −1.8257 | 41.17 |
| 3.6997 | −2.0002 | 41.17 |
| 5.5862 | −1.6884 | 41.17 |
| 4.0973 | −2.8165 | 41.17 |
| 5.2077 | −1.3843 | 41.17 |
| 5.1136 | −1.327 | 41.17 |
| 3.624 | −1.911 | 41.17 |
| 5.4574 | −1.5666 | 41.17 |
| 5.3883 | −1.5108 | 41.17 |
| 3.9475 | −2.396 | 41.17 |
| 4.7926 | −1.1616 | 41.17 |
| 4.271 | −0.9524 | 41.17 |
| 4.1266 | −2.9243 | 41.17 |
| 3.4428 | −1.7282 | 41.17 |
| 4.4029 | −1.0006 | 41.17 |
| 5.5235 | −1.6257 | 41.17 |
| 4.9195 | −1.2222 | 41.17 |
| 4.5339 | −1.0513 | 41.17 |
| 3.3373 | −1.6355 | 41.17 |
| 3.7705 | −2.0935 | 41.17 |
| −0.0293 | 0.0285 | 41.17 |
| 0.0088 | −0.0338 | 41.17 |
| −0.0243 | 0.0636 | 41.17 |
| −0.0264 | 0.0109 | 41.17 |
| 1.8163 | −0.2823 | 41.17 |
| 0.122 | −0.0887 | 41.17 |
| 2.5292 | −1.0959 | 41.17 |
| 0.0274 | −0.0461 | 41.17 |
| 4.0192 | −0.8668 | 41.17 |
| 0.9015 | −0.3772 | 41.17 |
| 0.5669 | −0.2551 | 41.17 |
| 2.8462 | −1.2826 | 41.17 |
| 2.7401 | −0.5038 | 41.17 |
| 2.108 | −0.8764 | 41.17 |
| −0.017 | 0.0797 | 41.17 |
| 0.3079 | 0.0461 | 41.17 |
| 3.0005 | −1.3829 | 41.17 |
| 0.1774 | −0.1103 | 41.17 |
| 3.7655 | −0.787 | 41.17 |
| 1.2352 | −0.5022 | 41.17 |
| 3.1157 | −1.4633 | 41.17 |
| 2.2789 | −0.3902 | 41.17 |
| 2.32 | −0.9834 | 41.17 |
| 2.9976 | −0.5704 | 41.17 |
| 3.5105 | −0.7114 | 41.17 |
| 0.0469 | −0.0568 | 41.17 |
| 0.1335 | 0.0825 | 41.17 |
| −0.0047 | 0.0924 | 41.17 |
| 1.4564 | −0.5888 | 41.17 |
| −0.0282 | 0.0462 | 41.17 |
| 0.6565 | −0.0273 | 41.17 |
| 0.0899 | 0.0914 | 41.17 |
| 0.0287 | 0.1031 | 41.17 |
| −0.0079 | −0.0191 | 41.17 |
| 3.2282 | −1.5474 | 41.17 |
| 0.3996 | −0.1939 | 41.17 |
| 3.2544 | −0.6394 | 41.17 |
| 1.6759 | −0.6796 | 41.17 |
| 1.8932 | −0.7753 | 41.17 |
| 1.3528 | −0.1783 | 41.17 |
| 2.6888 | −1.1872 | 41.17 |
| −0.0189 | −0.0052 | 41.17 |
| 0.0463 | 0.101 | 41.17 |
| 0.0112 | 0.1004 | 41.17 |
| 0.2328 | −0.1315 | 41.17 |
| −0.0243 | 0.0636 | 41.17 |
| 0.067 | −0.0664 | 41.17 |
| 4.8127 | −3.8632 | 41.69 |
| 5.7742 | −2.9544 | 41.69 |

TABLE 1-continued

The coordinate values given below provide the preferred nominal profile envelope information regarding the XYZ coordinates which are optimized for the 1st stage nozzle of a 7FB integrated gasification combined cycle (IGCC) gas turbine by the General Electric Company.

| X | Y | Z |
|---|---|---|
| 4.5644 | −3.7863 | 41.69 |
| 4.3716 | −3.5618 | 41.69 |
| 5.0541 | −3.7965 | 41.69 |
| 4.2733 | −3.3436 | 41.69 |
| 4.4017 | −3.6137 | 41.69 |
| 4.1874 | −3.0716 | 41.69 |
| 5.6866 | −1.795 | 41.69 |
| 5.8744 | −2.7156 | 41.69 |
| 5.8493 | −2.7881 | 41.69 |
| 4.1577 | −2.9629 | 41.69 |
| 5.9187 | −2.3379 | 41.69 |
| 5.8963 | −2.1995 | 41.69 |
| 4.7649 | −3.8602 | 41.69 |
| 4.2951 | −3.3993 | 41.69 |
| 5.922 | −2.4145 | 41.69 |
| 4.7177 | −3.852 | 41.69 |
| 5.8234 | −2.0028 | 41.69 |
| 5.8527 | −2.0665 | 41.69 |
| 5.8948 | −2.6418 | 41.69 |
| 4.4352 | −3.6631 | 41.69 |
| 4.4734 | −3.709 | 41.69 |
| 5.7229 | −3.0466 | 41.69 |
| 4.6716 | −3.839 | 41.69 |
| 5.6667 | −3.1357 | 41.69 |
| 4.9079 | −3.8537 | 41.69 |
| 5.9101 | −2.2683 | 41.69 |
| 5.14 | −3.7355 | 41.69 |
| 4.253 | −3.2873 | 41.69 |
| 5.7897 | −1.9413 | 41.69 |
| 5.437 | −3.4298 | 41.69 |
| 4.9588 | −3.8401 | 41.69 |
| 4.6163 | −3.8161 | 41.69 |
| 4.8605 | −3.861 | 41.69 |
| 5.1797 | −3.7007 | 41.69 |
| 5.9099 | −2.5669 | 41.69 |
| 4.2185 | −3.1799 | 41.69 |
| 4.3441 | −3.5085 | 41.69 |
| 4.3187 | −3.4542 | 41.69 |
| 4.5166 | −3.7504 | 41.69 |
| 5.0982 | −3.7677 | 41.69 |
| 5.82 | −2.8592 | 41.69 |
| 5.2545 | −3.6264 | 41.69 |
| 5.5241 | −3.3279 | 41.69 |
| 5.9191 | −2.491 | 41.69 |
| 5.0077 | −3.8208 | 41.69 |
| 5.7409 | −1.8662 | 41.69 |
| 5.6274 | −1.7279 | 41.69 |
| 5.8771 | −2.1321 | 41.69 |
| 5.2176 | −3.6641 | 41.69 |
| 5.3465 | −3.5288 | 41.69 |
| 5.6062 | −3.222 | 41.69 |
| 4.8279 | −1.1952 | 41.69 |
| 4.1278 | −2.8543 | 41.69 |
| 4.5674 | −1.0831 | 41.69 |
| 3.6473 | −1.9424 | 41.69 |
| 5.4975 | −1.605 | 41.69 |
| 5.246 | −1.4209 | 41.69 |
| 3.9743 | −2.4311 | 41.69 |
| 4.6983 | −1.1375 | 41.69 |
| 4.0956 | −2.7463 | 41.69 |
| 3.465 | −1.7575 | 41.69 |
| 5.5642 | −1.6646 | 41.69 |
| 3.7236 | −2.0324 | 41.69 |
| 5.1512 | −1.3628 | 41.69 |
| 4.0196 | −2.5342 | 41.69 |
| 4.3027 | −0.9821 | 41.69 |
| 3.8608 | −2.2245 | 41.69 |
| 5.428 | −1.5487 | 41.69 |
| 5.0543 | −1.3082 | 41.69 |
| 4.0598 | −2.6394 | 41.69 |
| 3.359 | −1.6638 | 41.69 |

TABLE 1-continued

The coordinate values given below provide the preferred nominal profile envelope information regarding the XYZ coordinates which are optimized for the 1st stage nozzle of a 7FB integrated gasification combined cycle (IGCC) gas turbine by the General Electric Company.

| X | Y | Z |
|---|---|---|
| 4.4355 | −1.0314 | 41.69 |
| 5.3383 | −1.4827 | 41.69 |
| 4.9557 | −1.2567 | 41.69 |
| 3.7949 | −2.1265 | 41.69 |
| 3.5667 | −1.8562 | 41.69 |
| 3.9207 | −2.3261 | 41.69 |
| 0.0297 | 0.1033 | 41.69 |
| −0.0167 | 0.0803 | 41.69 |
| 0.0278 | −0.0464 | 41.69 |
| 2.761 | −0.5223 | 41.69 |
| 0.5709 | −0.2598 | 41.69 |
| 0.2346 | −0.1334 | 41.69 |
| 0.0474 | 0.101 | 41.69 |
| 1.4664 | −0.6005 | 41.69 |
| 0.0475 | −0.0572 | 41.69 |
| 1.8304 | −0.2944 | 41.69 |
| 1.2438 | −0.5121 | 41.69 |
| 2.5461 | −1.1164 | 41.69 |
| −0.0295 | 0.0287 | 41.69 |
| 0.3109 | 0.0443 | 41.69 |
| 0.1231 | −0.0897 | 41.69 |
| 3.7937 | −0.8128 | 41.69 |
| 3.2492 | −1.5744 | 41.69 |
| 2.8651 | −1.3059 | 41.69 |
| −0.0078 | −0.0192 | 41.69 |
| 0.1352 | 0.0819 | 41.69 |
| 0.0119 | 0.1009 | 41.69 |
| 1.6873 | −0.693 | 41.69 |
| −0.0041 | 0.093 | 41.69 |
| 2.7068 | −1.2091 | 41.69 |
| −0.019 | −0.0052 | 41.69 |
| 2.2964 | −0.4055 | 41.69 |
| 0.0677 | −0.0669 | 41.69 |
| 0.0913 | 0.091 | 41.69 |
| 3.0203 | −0.5907 | 41.69 |
| −0.0242 | 0.0641 | 41.69 |
| 3.5369 | −0.7354 | 41.69 |
| 4.0492 | −0.8946 | 41.69 |
| 3.279 | −0.6616 | 41.69 |
| 2.3356 | −1.0021 | 41.69 |
| 1.906 | −0.7904 | 41.69 |
| 1.3635 | −0.1872 | 41.69 |
| 3.1362 | −1.4892 | 41.69 |
| 0.9078 | −0.3846 | 41.69 |
| 0.4025 | −0.1972 | 41.69 |
| 2.1222 | −0.8934 | 41.69 |
| −0.0242 | 0.0641 | 41.69 |
| −0.0282 | 0.0466 | 41.69 |
| 3.0203 | −1.4077 | 41.69 |
| 0.0091 | −0.0339 | 41.69 |
| −0.0266 | 0.011 | 41.69 |
| 0.1788 | −0.1117 | 41.69 |
| 0.6621 | −0.0314 | 41.69 |
| 5.9408 | −2.2422 | 42.21 |
| 5.2922 | −3.6801 | 42.21 |
| 5.9393 | −2.6882 | 42.21 |
| 5.8962 | −2.1081 | 42.21 |
| 5.7086 | −3.1859 | 42.21 |
| 4.1887 | −3.0015 | 42.21 |
| 4.3282 | −3.4412 | 42.21 |
| 5.9186 | −2.7626 | 42.21 |
| 4.2191 | −3.111 | 42.21 |
| 4.2508 | −3.2201 | 42.21 |
| 5.9638 | −2.3819 | 42.21 |
| 4.7034 | −3.8893 | 42.21 |
| 4.2858 | −3.3283 | 42.21 |
| 4.3062 | −3.3851 | 42.21 |
| 4.3518 | −3.4967 | 42.21 |
| 4.3773 | −3.5515 | 42.21 |
| 4.4047 | −3.6054 | 42.21 |
| 4.4346 | −3.658 | 42.21 |

TABLE 1-continued

The coordinate values given below provide the preferred nominal profile envelope information regarding the XYZ coordinates which are optimized for the 1st stage nozzle of a 7FB integrated gasification combined cycle (IGCC) gas turbine by the General Electric Company.

| X | Y | Z |
|---|---|---|
| 4.4679 | −3.7082 | 42.21 |
| 4.5058 | −3.7551 | 42.21 |
| 4.5397 | −3.7893 | 42.21 |
| 4.5767 | −3.8203 | 42.21 |
| 5.8932 | −2.8357 | 42.21 |
| 5.9641 | −2.5362 | 42.21 |
| 5.8321 | −1.982 | 42.21 |
| 4.6165 | −3.8476 | 42.21 |
| 5.4764 | −3.482 | 42.21 |
| 4.6588 | −3.8707 | 42.21 |
| 5.5644 | −3.3794 | 42.21 |
| 5.8173 | −3.0033 | 42.21 |
| 4.7497 | −3.9031 | 42.21 |
| 4.7972 | −3.9119 | 42.21 |
| 4.8454 | −3.9156 | 42.21 |
| 5.9547 | −2.6127 | 42.21 |
| 4.8936 | −3.9139 | 42.21 |
| 5.6685 | −1.767 | 42.21 |
| 4.9415 | −3.907 | 42.21 |
| 4.9929 | −3.8938 | 42.21 |
| 5.0424 | −3.8749 | 42.21 |
| 5.7829 | −1.9064 | 42.21 |
| 5.7654 | −3.0961 | 42.21 |
| 5.0895 | −3.8507 | 42.21 |
| 5.8636 | −2.9073 | 42.21 |
| 5.955 | −2.3116 | 42.21 |
| 5.1341 | −3.822 | 42.21 |
| 5.1764 | −3.7898 | 42.21 |
| 5.2166 | −3.7548 | 42.21 |
| 5.9212 | −2.1742 | 42.21 |
| 5.8664 | −2.0439 | 42.21 |
| 5.3851 | −3.5817 | 42.21 |
| 5.7281 | −1.8346 | 42.21 |
| 5.255 | −3.7181 | 42.21 |
| 5.6475 | −3.2728 | 42.21 |
| 5.9671 | −2.459 | 42.21 |
| 4.001 | −2.4662 | 42.21 |
| 4.0472 | −2.5699 | 42.21 |
| 4.0884 | −2.6758 | 42.21 |
| 4.125 | −2.7834 | 42.21 |
| 4.158 | −2.8921 | 42.21 |
| 5.6048 | −1.7033 | 42.21 |
| 5.1887 | −1.3985 | 42.21 |
| 5.5376 | −1.6431 | 42.21 |
| 5.0911 | −1.3432 | 42.21 |
| 5.2841 | −1.4572 | 42.21 |
| 4.4679 | −1.0622 | 42.21 |
| 5.4675 | −1.5863 | 42.21 |
| 4.7326 | −1.1701 | 42.21 |
| 4.9917 | −1.2911 | 42.21 |
| 4.6008 | −1.1148 | 42.21 |
| 3.3805 | −1.6921 | 42.21 |
| 3.4872 | −1.787 | 42.21 |
| 3.5895 | −1.8867 | 42.21 |
| 4.3342 | −1.012 | 42.21 |
| 3.6707 | −1.9737 | 42.21 |
| 3.7475 | −2.0646 | 42.21 |
| 5.3772 | −1.5197 | 42.21 |
| 3.8195 | −2.1594 | 42.21 |
| 3.886 | −2.2581 | 42.21 |
| 4.8631 | −1.2287 | 42.21 |
| 3.9467 | −2.3605 | 42.21 |
| 1.8444 | −0.307 | 42.21 |
| 0.0094 | −0.0341 | 42.21 |
| 0.6676 | −0.0357 | 42.21 |
| 0.0282 | −0.0467 | 42.21 |
| 4.0789 | −0.9227 | 42.21 |
| 0.048 | −0.0576 | 42.21 |
| 0.0684 | −0.0675 | 42.21 |
| 3.8217 | −0.8392 | 42.21 |
| 2.7816 | −0.5414 | 42.21 |

TABLE 1-continued

The coordinate values given below provide the preferred nominal profile envelope information regarding the XYZ coordinates which are optimized for the 1st stage nozzle of a 7FB integrated gasification combined cycle (IGCC) gas turbine by the General Electric Company.

| X | Y | Z |
|---|---|---|
| 0.1242 | −0.0907 | 42.21 |
| 0.0306 | 0.1035 | 42.21 |
| 0.1802 | −0.1132 | 42.21 |
| 0.0127 | 0.1013 | 42.21 |
| 0.2364 | −0.1354 | 42.21 |
| −0.0163 | 0.0809 | 42.21 |
| 0.4053 | −0.2007 | 42.21 |
| 0.5748 | −0.2646 | 42.21 |
| 0.3139 | 0.0425 | 42.21 |
| 2.3137 | −0.4214 | 42.21 |
| −0.024 | 0.0646 | 42.21 |
| 0.137 | 0.0813 | 42.21 |
| −0.0036 | 0.0936 | 42.21 |
| 3.5631 | −0.7599 | 42.21 |
| 1.2521 | −0.5222 | 42.21 |
| −0.0282 | 0.0469 | 42.21 |
| 1.4762 | −0.6124 | 42.21 |
| 1.6986 | −0.7066 | 42.21 |
| −0.0296 | 0.029 | 42.21 |
| 1.9187 | −0.8059 | 42.21 |
| −0.0267 | 0.0111 | 42.21 |
| 0.0927 | 0.0907 | 42.21 |
| 2.1363 | −0.9106 | 42.21 |
| −0.019 | −0.0052 | 42.21 |
| 2.351 | −1.0211 | 42.21 |
| 3.3034 | −0.6843 | 42.21 |
| 2.5628 | −1.1372 | 42.21 |
| 2.7245 | −1.2313 | 42.21 |
| 2.8837 | −1.3296 | 42.21 |
| 3.0399 | −1.4327 | 42.21 |
| 1.3741 | −0.1964 | 42.21 |
| 3.1564 | −1.5154 | 42.21 |
| 0.0485 | 0.101 | 42.21 |
| −0.0077 | −0.0194 | 42.21 |
| 3.2701 | −1.6017 | 42.21 |
| −0.024 | 0.0646 | 42.21 |
| 3.0428 | −0.6116 | 42.21 |
| 0.9139 | −0.3921 | 42.21 |
| 5.2926 | −3.7721 | 42.73 |
| 5.3302 | −3.7339 | 42.73 |
| 5.4239 | −3.6347 | 42.73 |
| 5.2131 | −3.8441 | 42.73 |
| 5.5161 | −3.5343 | 42.73 |
| 5.6049 | −3.4308 | 42.73 |
| 5.2538 | −3.809 | 42.73 |
| 5.6888 | −3.3234 | 42.73 |
| 5.7505 | −3.2359 | 42.73 |
| 4.4677 | −3.7022 | 42.73 |
| 5.8079 | −3.1454 | 42.73 |
| 5.8603 | −3.0519 | 42.73 |
| 5.907 | −2.9552 | 42.73 |
| 4.5008 | −3.7532 | 42.73 |
| 5.9369 | −2.8829 | 42.73 |
| 5.9625 | −2.8092 | 42.73 |
| 5.9834 | −2.7342 | 42.73 |
| 4.5384 | −3.8009 | 42.73 |
| 5.9989 | −2.6581 | 42.73 |
| 6.0083 | −2.5809 | 42.73 |
| 4.5721 | −3.8359 | 42.73 |
| 6.0114 | −2.5032 | 42.73 |
| 4.6089 | −3.8678 | 42.73 |
| 6.008 | −2.4254 | 42.73 |
| 5.9992 | −2.3545 | 42.73 |
| 5.9847 | −2.2846 | 42.73 |
| 5.9649 | −2.2161 | 42.73 |
| 5.9396 | −2.1494 | 42.73 |
| 5.9094 | −2.0848 | 42.73 |
| 5.8748 | −2.0223 | 42.73 |
| 5.825 | −1.9462 | 42.73 |
| 4.4379 | −3.649 | 42.73 |
| 4.6486 | −3.8959 | 42.73 |

TABLE 1-continued

The coordinate values given below provide the preferred nominal profile envelope information regarding the XYZ coordinates which are optimized for the 1st stage nozzle of a 7FB integrated gasification combined cycle (IGCC) gas turbine by the General Electric Company.

| X | Y | Z |
|---|---|---|
| 4.6909 | −3.9198 | 42.73 |
| 5.7697 | −1.8739 | 42.73 |
| 5.7097 | −1.8057 | 42.73 |
| 4.7356 | −3.9392 | 42.73 |
| 5.6454 | −1.7415 | 42.73 |
| 4.7821 | −3.9538 | 42.73 |
| 4.1879 | −2.9301 | 42.73 |
| 4.2195 | −3.0402 | 42.73 |
| 4.8298 | −3.9634 | 42.73 |
| 4.2506 | −3.1504 | 42.73 |
| 4.8783 | −3.9677 | 42.73 |
| 4.927 | −3.9666 | 42.73 |
| 4.2829 | −3.2604 | 42.73 |
| 4.9753 | −3.9603 | 42.73 |
| 4.3184 | −3.3694 | 42.73 |
| 5.0273 | −3.9475 | 42.73 |
| 4.339 | −3.4266 | 42.73 |
| 4.3612 | −3.4833 | 42.73 |
| 5.0774 | −3.9289 | 42.73 |
| 4.385 | −3.5392 | 42.73 |
| 4.4105 | −3.5945 | 42.73 |
| 5.1251 | −3.905 | 42.73 |
| 5.1703 | −3.8764 | 42.73 |
| 5.2261 | −1.4338 | 42.73 |
| 5.1278 | −1.3779 | 42.73 |
| 5.0278 | −1.3251 | 42.73 |
| 4.8982 | −1.2619 | 42.73 |
| 3.2907 | −1.6293 | 42.73 |
| 3.4018 | −1.7208 | 42.73 |
| 3.5091 | −1.8166 | 42.73 |
| 4.7668 | −1.2025 | 42.73 |
| 3.6121 | −1.9173 | 42.73 |
| 3.6939 | −2.0052 | 42.73 |
| 3.7714 | −2.0968 | 42.73 |
| 4.634 | −1.1463 | 42.73 |
| 3.8439 | −2.1924 | 42.73 |
| 4.5002 | −1.0929 | 42.73 |
| 3.9112 | −2.2918 | 42.73 |
| 4.3655 | −1.0419 | 42.73 |
| 3.9725 | −2.3949 | 42.73 |
| 4.0277 | −2.5013 | 42.73 |
| 4.1084 | −0.9511 | 42.73 |
| 4.0746 | −2.6057 | 42.73 |
| 4.1166 | −2.7124 | 42.73 |
| 4.1541 | −2.8206 | 42.73 |
| 5.5777 | −1.6808 | 42.73 |
| 5.5071 | −1.6235 | 42.73 |
| 5.416 | −1.5562 | 42.73 |
| 5.3223 | −1.4931 | 42.73 |
| 2.15 | −0.9283 | 42.73 |
| −0.0159 | 0.0815 | 42.73 |
| −0.0076 | −0.0195 | 42.73 |
| −0.0238 | 0.0651 | 42.73 |
| 2.3661 | −1.0406 | 42.73 |
| 0.0096 | −0.0344 | 42.73 |
| 2.5791 | −1.1585 | 42.73 |
| 2.7418 | −1.2539 | 42.73 |
| 2.902 | −1.3536 | 42.73 |
| 0.0287 | −0.047 | 42.73 |
| 3.0591 | −1.4583 | 42.73 |
| 0.0486 | −0.0581 | 42.73 |
| 3.1763 | −1.5419 | 42.73 |
| 0.0691 | −0.0681 | 42.73 |
| 0.1252 | −0.0917 | 42.73 |
| 0.1816 | −0.1148 | 42.73 |
| 0.2381 | −0.1375 | 42.73 |
| 3.8493 | −0.8659 | 42.73 |
| 3.5889 | −0.785 | 42.73 |
| 1.9311 | −0.8217 | 42.73 |
| 3.3274 | −0.7076 | 42.73 |
| 3.065 | −0.6331 | 42.73 |

TABLE 1-continued

The coordinate values given below provide the preferred nominal profile envelope information regarding the XYZ coordinates which are optimized for the 1st stage nozzle of a 7FB integrated gasification combined cycle (IGCC) gas turbine by the General Electric Company.

| X | Y | Z |
|---|---|---|
| 2.802 | −0.5611 | 42.73 |
| 2.3308 | −0.4378 | 42.73 |
| 1.8582 | −0.3201 | 42.73 |
| 1.3846 | −0.2062 | 42.73 |
| 0.6731 | −0.0402 | 42.73 |
| −0.0238 | 0.0651 | 42.73 |
| 0.3169 | 0.0405 | 42.73 |
| −0.0281 | 0.0473 | 42.73 |
| 0.1387 | 0.0807 | 42.73 |
| 0.4081 | −0.2042 | 42.73 |
| 0.0941 | 0.0903 | 42.73 |
| 0.5786 | −0.2695 | 42.73 |
| 0.9199 | −0.3998 | 42.73 |
| 0.0496 | 0.101 | 42.73 |
| 0.0316 | 0.1037 | 42.73 |
| −0.0296 | 0.0292 | 42.73 |
| −0.0268 | 0.0112 | 42.73 |
| −0.019 | −0.0053 | 42.73 |
| 1.2603 | −0.5327 | 42.73 |
| 0.0135 | 0.1017 | 42.73 |
| 1.4858 | −0.6247 | 42.73 |
| 1.7096 | −0.7207 | 42.73 |
| −0.003 | 0.0942 | 42.73 |
| 5.9504 | −3.0028 | 43.25 |
| 5.9172 | −2.0624 | 43.25 |
| 4.418 | −3.582 | 43.25 |
| 4.4437 | −3.6377 | 43.25 |
| 5.2067 | −3.9306 | 43.25 |
| 5.2501 | −3.8983 | 43.25 |
| 5.8113 | −1.9127 | 43.25 |
| 4.5009 | −3.7465 | 43.25 |
| 5.2912 | −3.8631 | 43.25 |
| 5.7507 | −1.844 | 43.25 |
| 4.4711 | −3.6928 | 43.25 |
| 4.25 | −3.0792 | 43.25 |
| 5.062 | −4.0011 | 43.25 |
| 5.3305 | −3.826 | 43.25 |
| 5.686 | −1.7792 | 43.25 |
| 5.9805 | −2.9299 | 43.25 |
| 5.6177 | −1.718 | 43.25 |
| 6.0063 | −2.8556 | 43.25 |
| 4.5338 | −3.7982 | 43.25 |
| 5.3685 | −3.7876 | 43.25 |
| 5.8504 | −3.1946 | 43.25 |
| 6.0273 | −2.78 | 43.25 |
| 6.0428 | −2.7032 | 43.25 |
| 5.7302 | −3.374 | 43.25 |
| 6.0523 | −2.6254 | 43.25 |
| 4.2175 | −2.9684 | 43.25 |
| 4.5711 | −3.8469 | 43.25 |
| 6.0554 | −2.547 | 43.25 |
| 4.6412 | −3.9154 | 43.25 |
| 5.556 | −3.5864 | 43.25 |
| 4.6809 | −3.9442 | 43.25 |
| 4.7233 | −3.9687 | 43.25 |
| 5.6456 | −3.4822 | 43.25 |
| 4.2818 | −3.1902 | 43.25 |
| 6.052 | −2.4686 | 43.25 |
| 4.3149 | −3.3009 | 43.25 |
| 6.043 | −2.3972 | 43.25 |
| 6.0284 | −2.3267 | 43.25 |
| 4.6046 | −3.8828 | 43.25 |
| 6.0082 | −2.2576 | 43.25 |
| 4.3508 | −3.4107 | 43.25 |
| 4.7682 | −3.9887 | 43.25 |
| 4.9117 | −4.0195 | 43.25 |
| 4.815 | −4.0039 | 43.25 |
| 5.1127 | −3.9829 | 43.25 |
| 4.8629 | −4.0143 | 43.25 |
| 5.1609 | −3.9592 | 43.25 |
| 5.7925 | −3.2857 | 43.25 |

TABLE 1-continued

The coordinate values given below provide the preferred nominal profile envelope information regarding the XYZ coordinates which are optimized for the 1st stage nozzle of a 7FB integrated gasification combined cycle (IGCC) gas turbine by the General Electric Company.

| X | Y | Z |
|---|---|---|
| 5.463 | −3.6877 | 43.25 |
| 5.8671 | −1.9856 | 43.25 |
| 4.9607 | −4.0191 | 43.25 |
| 4.3717 | −3.4684 | 43.25 |
| 4.3941 | −3.5255 | 43.25 |
| 5.9827 | −2.1905 | 43.25 |
| 5.0094 | −4.0134 | 43.25 |
| 5.9522 | −2.1253 | 43.25 |
| 5.9033 | −3.1003 | 43.25 |
| 3.8682 | −2.2257 | 43.25 |
| 4.5325 | −1.1234 | 43.25 |
| 4.3968 | −1.0716 | 43.25 |
| 3.9361 | −2.3258 | 43.25 |
| 3.9982 | −2.4296 | 43.25 |
| 4.1378 | −0.9793 | 43.25 |
| 4.0541 | −2.5368 | 43.25 |
| 4.9333 | −1.2946 | 43.25 |
| 4.1018 | −2.6419 | 43.25 |
| 4.8009 | −1.2345 | 43.25 |
| 4.1445 | −2.7492 | 43.25 |
| 5.3604 | −1.5286 | 43.25 |
| 4.1828 | −2.8582 | 43.25 |
| 5.5466 | −1.6602 | 43.25 |
| 5.4548 | −1.5923 | 43.25 |
| 5.2635 | −1.4686 | 43.25 |
| 5.1646 | −1.412 | 43.25 |
| 5.0638 | −1.3586 | 43.25 |
| 4.6672 | −1.1775 | 43.25 |
| 3.3109 | −1.6574 | 43.25 |
| 3.4227 | −1.7499 | 43.25 |
| 3.6344 | −1.9484 | 43.25 |
| 3.5307 | −1.8467 | 43.25 |
| 3.7168 | −2.037 | 43.25 |
| 3.795 | −2.1294 | 43.25 |
| 0.6785 | −0.0449 | 43.25 |
| −0.0236 | 0.0656 | 43.25 |
| −0.0297 | 0.0294 | 43.25 |
| −0.0269 | 0.0113 | 43.25 |
| 0.3198 | 0.0385 | 43.25 |
| 0.1404 | 0.0799 | 43.25 |
| −0.0191 | −0.0053 | 43.25 |
| 0.0955 | 0.09 | 43.25 |
| 0.5824 | −0.2745 | 43.25 |
| 0.0099 | −0.0346 | 43.25 |
| 0.0291 | −0.0473 | 43.25 |
| 0.0698 | −0.0687 | 43.25 |
| 0.1263 | −0.0928 | 43.25 |
| 0.183 | −0.1163 | 43.25 |
| 2.7588 | −1.2771 | 43.25 |
| 0.2398 | −0.1395 | 43.25 |
| −0.0281 | 0.0477 | 43.25 |
| 3.8769 | −0.8926 | 43.25 |
| 0.4109 | −0.2077 | 43.25 |
| 3.6146 | −0.8101 | 43.25 |
| 0.0507 | 0.101 | 43.25 |
| 0.9258 | −0.4077 | 43.25 |
| 0.0492 | −0.0585 | 43.25 |
| 0.0326 | 0.1039 | 43.25 |
| 1.2683 | −0.5434 | 43.25 |
| 0.0144 | 0.1022 | 43.25 |
| −0.0024 | 0.0947 | 43.25 |
| 1.4952 | −0.6372 | 43.25 |
| 3.3512 | −0.7311 | 43.25 |
| 3.087 | −0.6549 | 43.25 |
| −0.0075 | −0.0196 | 43.25 |
| 1.7204 | −0.7351 | 43.25 |
| 1.9432 | −0.8379 | 43.25 |
| −0.0156 | 0.082 | 43.25 |
| −0.0236 | 0.0656 | 43.25 |
| 2.1635 | −0.9463 | 43.25 |
| 2.3809 | −1.0604 | 43.25 |

TABLE 1-continued

The coordinate values given below provide the preferred nominal profile envelope information regarding the XYZ coordinates which are optimized for the 1st stage nozzle of a 7FB integrated gasification combined cycle (IGCC) gas turbine by the General Electric Company.

| X | Y | Z |
|---|---|---|
| 2.5952 | −1.1802 | 43.25 |
| 2.9199 | −1.3782 | 43.25 |
| 3.0779 | −1.4842 | 43.25 |
| 3.1958 | −1.569 | 43.25 |
| 2.8221 | −0.5812 | 43.25 |
| 2.3477 | −0.4547 | 43.25 |
| 1.8717 | −0.3336 | 43.25 |
| 1.3949 | −0.2162 | 43.25 |
| 4.8352 | −1.2659 | 43.77 |
| 4.7005 | −1.2084 | 43.77 |
| 4.5648 | −1.1537 | 43.77 |
| 4.4281 | −1.1014 | 43.77 |
| 4.1672 | −1.0076 | 43.77 |
| 1.731 | −0.7497 | 43.77 |
| 1.9552 | −0.8545 | 43.77 |
| 2.1768 | −0.9647 | 43.77 |
| 2.3954 | −1.0806 | 43.77 |
| 2.611 | −1.2023 | 43.77 |
| 2.7755 | −1.3007 | 43.77 |
| 2.9375 | −1.4033 | 43.77 |
| 3.0964 | −1.5107 | 43.77 |
| 3.215 | −1.5965 | 43.77 |
| 3.109 | −0.6766 | 43.77 |
| 2.8422 | −0.6012 | 43.77 |
| 2.3645 | −0.4716 | 43.77 |
| 3.9044 | −0.9192 | 43.77 |
| 3.6403 | −0.8351 | 43.77 |
| 3.375 | −0.7544 | 43.77 |
| 0.2416 | −0.1416 | 43.77 |
| 0.4136 | −0.2112 | 43.77 |
| 0.5862 | −0.2796 | 43.77 |
| 0.9316 | −0.4157 | 43.77 |
| 1.2761 | −0.5543 | 43.77 |
| 1.5045 | −0.65 | 43.77 |
| 0.0165 | −0.0393 | 43.77 |
| 1.8853 | −0.3472 | 43.77 |
| 0.6839 | −0.0498 | 43.77 |
| 0.3228 | 0.0364 | 43.77 |
| 0.1422 | 0.0792 | 43.77 |
| 0.0969 | 0.0895 | 43.77 |
| 0.0519 | 0.1009 | 43.77 |
| −0.0234 | 0.0661 | 43.77 |
| 0.0336 | 0.1041 | 43.77 |
| 0.0152 | 0.1026 | 43.77 |
| −0.0018 | 0.0953 | 43.77 |
| −0.028 | 0.0481 | 43.77 |
| −0.0152 | 0.0826 | 43.77 |
| −0.0298 | 0.0297 | 43.77 |
| −0.027 | 0.0114 | 43.77 |
| −0.0191 | −0.0054 | 43.77 |
| −0.0074 | −0.0197 | 43.77 |
| 0.0429 | −0.0553 | 43.77 |
| 1.4052 | −0.2264 | 43.77 |
| 0.0706 | −0.0693 | 43.77 |
| 0.1273 | −0.0939 | 43.77 |
| 0.1844 | −0.1179 | 43.77 |
| −0.0234 | 0.0661 | 43.77 |
| 6.0963 | −2.6696 | 43.77 |
| 6.0993 | −2.5906 | 43.77 |
| 6.0957 | −2.5115 | 43.77 |
| 6.0866 | −2.4395 | 43.77 |
| 6.0718 | −2.3685 | 43.77 |
| 5.0969 | −4.0546 | 43.77 |
| 4.3129 | −3.2305 | 43.77 |
| 4.7135 | −3.9925 | 43.77 |
| 5.197 | −4.0132 | 43.77 |
| 6.0514 | −2.2989 | 43.77 |
| 6.0256 | −2.2312 | 43.77 |
| 4.2112 | −2.8964 | 43.77 |
| 4.756 | −4.0178 | 43.77 |
| 5.9948 | −2.1656 | 43.77 |

TABLE 1-continued

The coordinate values given below provide the preferred nominal profile envelope information regarding the XYZ coordinates which are optimized for the 1st stage nozzle of a 7FB integrated gasification combined cycle (IGCC) gas turbine by the General Electric Company.

| X | Y | Z |
|---|---|---|
| 5.2433 | −3.9848 | 43.77 |
| 5.9596 | −2.1021 | 43.77 |
| 5.909 | −2.0247 | 43.77 |
| 5.1482 | −4.0368 | 43.77 |
| 4.801 | −4.0385 | 43.77 |
| 5.2872 | −3.9524 | 43.77 |
| 4.2468 | −3.0072 | 43.77 |
| 5.8528 | −1.9512 | 43.77 |
| 4.2802 | −3.1187 | 43.77 |
| 5.7918 | −1.8819 | 43.77 |
| 5.7266 | −1.8165 | 43.77 |
| 5.6578 | −1.7548 | 43.77 |
| 5.3289 | −3.9171 | 43.77 |
| 4.4269 | −3.5682 | 43.77 |
| 5.3686 | −3.8797 | 43.77 |
| 4.4043 | −3.5107 | 43.77 |
| 5.4069 | −3.8411 | 43.77 |
| 4.4511 | −3.6251 | 43.77 |
| 5.5024 | −3.7405 | 43.77 |
| 5.5962 | −3.6385 | 43.77 |
| 4.8479 | −4.0545 | 43.77 |
| 5.6865 | −3.5334 | 43.77 |
| 4.4769 | −3.6814 | 43.77 |
| 4.5044 | −3.7369 | 43.77 |
| 5.7719 | −3.4243 | 43.77 |
| 5.8348 | −3.3354 | 43.77 |
| 4.8961 | −4.0656 | 43.77 |
| 4.5342 | −3.7912 | 43.77 |
| 4.3466 | −3.342 | 43.77 |
| 4.5671 | −3.8436 | 43.77 |
| 5.8932 | −3.2435 | 43.77 |
| 5.9464 | −3.1485 | 43.77 |
| 4.6041 | −3.893 | 43.77 |
| 5.9939 | −3.0502 | 43.77 |
| 4.6374 | −3.9297 | 43.77 |
| 6.0241 | −2.9767 | 43.77 |
| 4.9452 | −4.0714 | 43.77 |
| 5.0438 | −4.0664 | 43.77 |
| 4.6739 | −3.963 | 43.77 |
| 4.3832 | −3.4526 | 43.77 |
| 6.0501 | −2.9018 | 43.77 |
| 6.0712 | −2.8255 | 43.77 |
| 4.9946 | −4.0716 | 43.77 |
| 6.0868 | −2.7481 | 43.77 |
| 4.1285 | −2.6786 | 43.77 |
| 4.172 | −2.7867 | 43.77 |
| 5.3011 | −1.5025 | 43.77 |
| 5.2014 | −1.4453 | 43.77 |
| 5.3986 | −1.5632 | 43.77 |
| 5.0999 | −1.3912 | 43.77 |
| 3.4432 | −1.7795 | 43.77 |
| 3.552 | −1.8774 | 43.77 |
| 3.3308 | −1.686 | 43.77 |
| 4.9685 | −1.3266 | 43.77 |
| 3.6564 | −1.98 | 43.77 |
| 3.7394 | −2.0693 | 43.77 |
| 3.8182 | −2.1625 | 43.77 |
| 5.5861 | −1.6964 | 43.77 |
| 3.8921 | −2.2596 | 43.77 |
| 5.4938 | −1.6277 | 43.77 |
| 3.9607 | −2.3604 | 43.77 |
| 4.0235 | −2.4649 | 43.77 |
| 4.0802 | −2.5728 | 43.77 |
| 5.184 | −4.0904 | 44.29 |
| 5.2333 | −4.067 | 44.29 |
| 5.2802 | −4.0386 | 44.29 |
| 4.4154 | −3.495 | 44.29 |
| 5.3246 | −4.0062 | 44.29 |
| 4.4368 | −3.5536 | 44.29 |
| 4.4597 | −3.6116 | 44.29 |
| 5.3667 | −3.9708 | 44.29 |

TABLE 1-continued

The coordinate values given below provide the preferred nominal profile envelope information regarding the XYZ coordinates which are optimized for the 1st stage nozzle of a 7FB integrated gasification combined cycle (IGCC) gas turbine by the General Electric Company.

| X | Y | Z |
|---|---|---|
| 5.4068 | −3.9332 | 44.29 |
| 5.4456 | −3.8944 | 44.29 |
| 4.4842 | −3.6689 | 44.29 |
| 6.068 | −3.0232 | 44.29 |
| 5.5419 | −3.7931 | 44.29 |
| 4.5102 | −3.7256 | 44.29 |
| 4.5379 | −3.7816 | 44.29 |
| 6.0941 | −2.9477 | 44.29 |
| 4.5677 | −3.8365 | 44.29 |
| 6.0373 | −2.2055 | 44.29 |
| 6.0018 | −2.1416 | 44.29 |
| 6.1152 | −2.8707 | 44.29 |
| 6.1308 | −2.7927 | 44.29 |
| 4.6373 | −3.9397 | 44.29 |
| 5.9508 | −2.0635 | 44.29 |
| 5.8942 | −1.9894 | 44.29 |
| 5.8328 | −1.9194 | 44.29 |
| 5.7671 | −1.8534 | 44.29 |
| 4.6705 | −3.977 | 44.29 |
| 6.1402 | −2.7136 | 44.29 |
| 4.6004 | −3.8895 | 44.29 |
| 4.7068 | −4.0111 | 44.29 |
| 4.7464 | −4.0414 | 44.29 |
| 4.3101 | −3.159 | 44.29 |
| 4.7889 | −4.0673 | 44.29 |
| 4.3436 | −3.2715 | 44.29 |
| 4.834 | −4.0887 | 44.29 |
| 4.8811 | −4.1053 | 44.29 |
| 4.3782 | −3.3837 | 44.29 |
| 6.1432 | −2.6339 | 44.29 |
| 6.1394 | −2.5542 | 44.29 |
| 6.1301 | −2.4816 | 44.29 |
| 4.9296 | −4.117 | 44.29 |
| 5.6366 | −3.6903 | 44.29 |
| 5.7278 | −3.5845 | 44.29 |
| 5.8139 | −3.4746 | 44.29 |
| 4.979 | −4.1233 | 44.29 |
| 6.1151 | −2.41 | 44.29 |
| 5.8773 | −3.3849 | 44.29 |
| 5.9361 | −3.2923 | 44.29 |
| 5.9898 | −3.1965 | 44.29 |
| 5.0288 | −4.1241 | 44.29 |
| 6.0945 | −2.3399 | 44.29 |
| 6.0376 | −3.0973 | 44.29 |
| 6.0684 | −2.2717 | 44.29 |
| 5.0785 | −4.1194 | 44.29 |
| 4.2757 | −3.0468 | 44.29 |
| 5.1321 | −4.108 | 44.29 |
| 4.4596 | −1.1294 | 44.29 |
| 4.1968 | −1.0344 | 44.29 |
| 4.5972 | −1.1826 | 44.29 |
| 5.3389 | −1.5364 | 44.29 |
| 5.6979 | −1.7911 | 44.29 |
| 5.6258 | −1.7321 | 44.29 |
| 3.3503 | −1.7152 | 44.29 |
| 5.5328 | −1.6628 | 44.29 |
| 5.4371 | −1.5977 | 44.29 |
| 3.4634 | −1.8098 | 44.29 |
| 3.5728 | −1.9087 | 44.29 |
| 3.6779 | −2.0123 | 44.29 |
| 4.734 | −1.2382 | 44.29 |
| 3.7615 | −2.1025 | 44.29 |
| 5.1363 | −1.4238 | 44.29 |
| 3.8409 | −2.1964 | 44.29 |
| 5.0039 | −1.3583 | 44.29 |
| 3.9154 | −2.2942 | 44.29 |
| 5.2385 | −1.4785 | 44.29 |
| 4.8696 | −1.2966 | 44.29 |
| 3.9847 | −2.3958 | 44.29 |
| 4.0483 | −2.501 | 44.29 |
| 4.1057 | −2.6096 | 44.29 |

TABLE 1-continued

The coordinate values given below provide the preferred nominal profile envelope information regarding the XYZ coordinates which are optimized for the 1st stage nozzle of a 7FB integrated gasification combined cycle (IGCC) gas turbine by the General Electric Company.

| X | Y | Z |
|---|---|---|
| 4.1548 | −2.7161 | 44.29 |
| 4.1991 | −2.8248 | 44.29 |
| 4.2392 | −2.9352 | 44.29 |
| 0.2433 | −0.1436 | 44.29 |
| 0.4163 | −0.2148 | 44.29 |
| 2.1899 | −0.9834 | 44.29 |
| 0.5899 | −0.2846 | 44.29 |
| 0.9374 | −0.4237 | 44.29 |
| 1.284 | −0.5653 | 44.29 |
| 1.5137 | −0.6629 | 44.29 |
| 3.9321 | −0.9449 | 44.29 |
| 3.6661 | −0.8594 | 44.29 |
| 1.7415 | −0.7646 | 44.29 |
| 3.3989 | −0.7773 | 44.29 |
| 3.131 | −0.698 | 44.29 |
| 1.967 | −0.8713 | 44.29 |
| 2.8624 | −0.621 | 44.29 |
| 2.3813 | −0.4883 | 44.29 |
| 2.4098 | −1.1013 | 44.29 |
| 2.6265 | −1.2249 | 44.29 |
| 1.8988 | −0.3607 | 44.29 |
| 1.4154 | −0.2366 | 44.29 |
| 0.6893 | −0.0547 | 44.29 |
| 2.792 | −1.3247 | 44.29 |
| 0.3257 | 0.0342 | 44.29 |
| 2.9549 | −1.4288 | 44.29 |
| 3.1146 | −1.5377 | 44.29 |
| 3.2339 | −1.6247 | 44.29 |
| 0.1439 | 0.0785 | 44.29 |
| 0.0983 | 0.0891 | 44.29 |
| −0.0232 | 0.0666 | 44.29 |
| −0.028 | 0.0485 | 44.29 |
| 0.053 | 0.1009 | 44.29 |
| −0.0299 | 0.0299 | 44.29 |
| 0.0346 | 0.1043 | 44.29 |
| −0.0272 | 0.0115 | 44.29 |
| 0.016 | 0.103 | 44.29 |
| −0.0011 | 0.0958 | 44.29 |
| −0.0148 | 0.0832 | 44.29 |
| −0.0232 | 0.0666 | 44.29 |
| −0.0191 | −0.0054 | 44.29 |
| −0.0073 | −0.0198 | 44.29 |
| 0.0168 | −0.0395 | 44.29 |
| 0.0434 | −0.0558 | 44.29 |
| 0.0713 | −0.0698 | 44.29 |
| 0.1284 | −0.0949 | 44.29 |
| 0.1858 | −0.1194 | 44.29 |
| 6.0335 | −3.2443 | 44.81 |
| 6.0816 | −3.1443 | 44.81 |
| 4.4474 | −3.5383 | 44.81 |
| 6.1121 | −3.0696 | 44.81 |
| 4.4725 | −3.6056 | 44.81 |
| 4.4994 | −3.6722 | 44.81 |
| 4.5283 | −3.7379 | 44.81 |
| 6.1383 | −2.9934 | 44.81 |
| 4.5592 | −3.8029 | 44.81 |
| 4.5924 | −3.8667 | 44.81 |
| 4.6291 | −3.9285 | 44.81 |
| 4.6707 | −3.9869 | 44.81 |
| 6.1594 | −2.9158 | 44.81 |
| 6.175 | −2.837 | 44.81 |
| 5.7146 | −3.6998 | 44.81 |
| 4.7037 | −4.025 | 44.81 |
| 4.74 | −4.0597 | 44.81 |
| 6.1843 | −2.7573 | 44.81 |
| 6.187 | −2.677 | 44.81 |
| 4.7794 | −4.0907 | 44.81 |
| 6.183 | −2.5967 | 44.81 |
| 4.822 | −4.1173 | 44.81 |
| 4.8672 | −4.1393 | 44.81 |
| 4.9146 | −4.1564 | 44.81 |

TABLE 1-continued

The coordinate values given below provide the preferred nominal profile envelope information regarding the XYZ coordinates which are optimized for the 1st stage nozzle of a 7FB integrated gasification combined cycle (IGCC) gas turbine by the General Electric Company.

| X | Y | Z |
|---|---|---|
| 4.3042 | −3.0872 | 44.81 |
| 4.9634 | −4.1686 | 44.81 |
| 6.1734 | −2.5235 | 44.81 |
| 6.1582 | −2.4514 | 44.81 |
| 6.1373 | −2.3807 | 44.81 |
| 5.0132 | −4.1755 | 44.81 |
| 4.4094 | −3.4262 | 44.81 |
| 5.0634 | −4.1767 | 44.81 |
| 6.111 | −2.312 | 44.81 |
| 4.374 | −3.3133 | 44.81 |
| 6.0796 | −2.2453 | 44.81 |
| 6.0438 | −2.1808 | 44.81 |
| 5.1134 | −4.1723 | 44.81 |
| 5.1676 | −4.1612 | 44.81 |
| 5.9924 | −2.1021 | 44.81 |
| 5.3622 | −4.0598 | 44.81 |
| 5.22 | −4.1439 | 44.81 |
| 4.3395 | −3.2001 | 44.81 |
| 5.9354 | −2.0274 | 44.81 |
| 5.2699 | −4.1206 | 44.81 |
| 5.3172 | −4.0923 | 44.81 |
| 5.4048 | −4.0242 | 44.81 |
| 5.4454 | −3.9865 | 44.81 |
| 5.4845 | −3.9474 | 44.81 |
| 5.8736 | −1.9567 | 44.81 |
| 5.5624 | −3.866 | 44.81 |
| 5.6394 | −3.7836 | 44.81 |
| 5.7871 | −3.6136 | 44.81 |
| 5.8076 | −1.8901 | 44.81 |
| 5.8562 | −3.5246 | 44.81 |
| 5.9201 | −3.4343 | 44.81 |
| 5.9794 | −3.3409 | 44.81 |
| 5.738 | −1.827 | 44.81 |
| 4.2265 | −1.0609 | 44.81 |
| 4.0723 | −2.5381 | 44.81 |
| 4.1305 | −2.6474 | 44.81 |
| 4.1805 | −2.7546 | 44.81 |
| 4.2257 | −2.8639 | 44.81 |
| 5.3767 | −1.5694 | 44.81 |
| 4.2667 | −2.975 | 44.81 |
| 5.2756 | −1.5109 | 44.81 |
| 4.4911 | −1.1574 | 44.81 |
| 3.2523 | −1.6535 | 44.81 |
| 4.6298 | −1.2113 | 44.81 |
| 3.3693 | −1.7452 | 44.81 |
| 3.483 | −1.8409 | 44.81 |
| 4.7675 | −1.2677 | 44.81 |
| 3.593 | −1.9409 | 44.81 |
| 3.6987 | −2.0456 | 44.81 |
| 5.1726 | −1.4556 | 44.81 |
| 5.0394 | −1.3892 | 44.81 |
| 4.9041 | −1.3268 | 44.81 |
| 3.7829 | −2.1366 | 44.81 |
| 5.6654 | −1.7674 | 44.81 |
| 3.8628 | −2.2313 | 44.81 |
| 5.5719 | −1.6973 | 44.81 |
| 3.938 | −2.3299 | 44.81 |
| 4.008 | −2.4322 | 44.81 |
| 5.4755 | −1.6314 | 44.81 |
| 0.419 | −0.2183 | 44.81 |
| 3.9599 | −0.9701 | 44.81 |
| 0.5936 | −0.2897 | 44.81 |
| 3.6919 | −0.8833 | 44.81 |
| 0.9431 | −0.4318 | 44.81 |
| 3.4229 | −0.7998 | 44.81 |
| 3.153 | −0.719 | 44.81 |
| 2.8825 | −0.6404 | 44.81 |
| 2.3981 | −0.5047 | 44.81 |
| 1.9123 | −0.3741 | 44.81 |
| 1.4256 | −0.2466 | 44.81 |
| 0.6946 | −0.0596 | 44.81 |

TABLE 1-continued

The coordinate values given below provide the preferred nominal profile envelope information regarding the XYZ coordinates which are optimized for the 1st stage nozzle of a 7FB integrated gasification combined cycle (IGCC) gas turbine by the General Electric Company.

| X | Y | Z |
|---|---|---|
| 0.3286 | 0.0321 | 44.81 |
| 1.2917 | −0.5764 | 44.81 |
| 1.5227 | −0.676 | 44.81 |
| 1.7518 | −0.7797 | 44.81 |
| 1.9786 | −0.8884 | 44.81 |
| 2.4238 | −1.1224 | 44.81 |
| 0.1456 | 0.0777 | 44.81 |
| 0.0997 | 0.0887 | 44.81 |
| 0.0541 | 0.1008 | 44.81 |
| 2.2027 | −1.0025 | 44.81 |
| 0.0356 | 0.1044 | 44.81 |
| 0.0169 | 0.1034 | 44.81 |
| 2.6417 | −1.248 | 44.81 |
| 2.808 | −1.3494 | 44.81 |
| −0.0005 | 0.0964 | 44.81 |
| −0.0144 | 0.0838 | 44.81 |
| 2.9718 | −1.455 | 44.81 |
| 3.1324 | −1.5654 | 44.81 |
| −0.023 | 0.0671 | 44.81 |
| −0.023 | 0.0671 | 44.81 |
| −0.0279 | 0.0489 | 44.81 |
| −0.03 | 0.0302 | 44.81 |
| −0.0273 | 0.0116 | 44.81 |
| −0.0192 | −0.0054 | 44.81 |
| −0.0072 | −0.0199 | 44.81 |
| 0.0171 | −0.0398 | 44.81 |
| 0.044 | −0.0561 | 44.81 |
| 0.0719 | −0.0704 | 44.81 |
| 0.1294 | −0.096 | 44.81 |
| 0.1871 | −0.1209 | 44.81 |
| 0.245 | −0.1456 | 44.81 |
| 5.3546 | −4.1457 | 45.33 |
| 6.0334 | −2.1408 | 45.33 |
| 5.9761 | −2.0654 | 45.33 |
| 5.4 | −4.1132 | 45.33 |
| 5.4431 | −4.0775 | 45.33 |
| 5.9138 | −1.9941 | 45.33 |
| 5.8475 | −1.9267 | 45.33 |
| 6.1564 | −3.1159 | 45.33 |
| 4.4349 | −3.4533 | 45.33 |
| 4.4791 | −3.5823 | 45.33 |
| 4.5047 | −3.65 | 45.33 |
| 5.7775 | −1.863 | 45.33 |
| 6.1826 | −3.039 | 45.33 |
| 4.5321 | −3.717 | 45.33 |
| 4.5613 | −3.7832 | 45.33 |
| 4.5926 | −3.8486 | 45.33 |
| 6.2037 | −2.9607 | 45.33 |
| 4.626 | −3.913 | 45.33 |
| 4.6627 | −3.9754 | 45.33 |
| 4.7043 | −4.0347 | 45.33 |
| 6.1258 | −3.1913 | 45.33 |
| 6.2192 | −2.8813 | 45.33 |
| 4.7372 | −4.0733 | 45.33 |
| 4.353 | −3.1933 | 45.33 |
| 5.4842 | −4.0397 | 45.33 |
| 4.7734 | −4.1087 | 45.33 |
| 4.8128 | −4.1403 | 45.33 |
| 5.5238 | −4.0004 | 45.33 |
| 5.6025 | −3.9184 | 45.33 |
| 4.8554 | −4.1675 | 45.33 |
| 4.9008 | −4.1901 | 45.33 |
| 5.6801 | −3.8355 | 45.33 |
| 6.2283 | −2.801 | 45.33 |
| 6.0775 | −3.2921 | 45.33 |
| 5.7561 | −3.7511 | 45.33 |
| 4.3104 | −3.0639 | 45.33 |
| 5.8292 | −3.6643 | 45.33 |
| 6.2307 | −2.72 | 45.33 |
| 4.9484 | −4.2077 | 45.33 |
| 5.8989 | −3.5747 | 45.33 |

TABLE 1-continued

The coordinate values given below provide the preferred nominal profile envelope information regarding the XYZ coordinates which are optimized for the 1st stage nozzle of a 7FB integrated gasification combined cycle (IGCC) gas turbine by the General Electric Company.

| X | Y | Z |
|---|---|---|
| 6.2264 | −2.639 | 45.33 |
| 4.9975 | −4.2204 | 45.33 |
| 5.9633 | −3.4837 | 45.33 |
| 5.0476 | −4.2277 | 45.33 |
| 5.0982 | −4.2292 | 45.33 |
| 4.3937 | −3.3234 | 45.33 |
| 6.0852 | −2.2201 | 45.33 |
| 6.2165 | −2.5654 | 45.33 |
| 5.1487 | −4.2252 | 45.33 |
| 5.2034 | −4.2144 | 45.33 |
| 5.2563 | −4.1973 | 45.33 |
| 6.2008 | −2.4927 | 45.33 |
| 6.0231 | −3.3895 | 45.33 |
| 5.3067 | −4.1741 | 45.33 |
| 6.1797 | −2.4215 | 45.33 |
| 6.153 | −2.3522 | 45.33 |
| 6.1213 | −2.2851 | 45.33 |
| 4.662 | −1.2397 | 45.33 |
| 4.5224 | −1.185 | 45.33 |
| 4.2559 | −1.0872 | 45.33 |
| 5.7045 | −1.8026 | 45.33 |
| 5.6105 | −1.7317 | 45.33 |
| 5.5135 | −1.6651 | 45.33 |
| 5.4141 | −1.6023 | 45.33 |
| 3.2698 | −1.6834 | 45.33 |
| 3.3874 | −1.7763 | 45.33 |
| 5.3123 | −1.5431 | 45.33 |
| 3.5017 | −1.8731 | 45.33 |
| 3.6122 | −1.9742 | 45.33 |
| 3.7185 | −2.08 | 45.33 |
| 3.8032 | −2.1719 | 45.33 |
| 5.2087 | −1.4871 | 45.33 |
| 3.8837 | −2.2674 | 45.33 |
| 5.0745 | −1.4199 | 45.33 |
| 3.9595 | −2.3667 | 45.33 |
| 4.0302 | −2.4698 | 45.33 |
| 4.0953 | −2.5763 | 45.33 |
| 4.1544 | −2.6863 | 45.33 |
| 4.9383 | −1.3567 | 45.33 |
| 4.2122 | −2.8096 | 45.33 |
| 4.2639 | −2.9357 | 45.33 |
| 4.8007 | −1.2968 | 45.33 |
| 1.2992 | −0.5877 | 45.33 |
| −0.0228 | 0.0677 | 45.33 |
| 3.7175 | −0.9069 | 45.33 |
| 3.9874 | −0.995 | 45.33 |
| 3.4466 | −0.822 | 45.33 |
| 1.5315 | −0.6894 | 45.33 |
| 3.1749 | −0.7398 | 45.33 |
| 1.7618 | −0.7952 | 45.33 |
| −0.0279 | 0.0493 | 45.33 |
| 2.9025 | −0.6596 | 45.33 |
| −0.0301 | 0.0305 | 45.33 |
| 1.9898 | −0.906 | 45.33 |
| 2.215 | −1.0222 | 45.33 |
| 2.4372 | −1.1442 | 45.33 |
| 0.1304 | −0.097 | 45.33 |
| 0.1884 | −0.1225 | 45.33 |
| 1.9257 | −0.3873 | 45.33 |
| 1.4357 | −0.2567 | 45.33 |
| 0.6999 | −0.0645 | 45.33 |
| 0.2466 | −0.1477 | 45.33 |
| 2.6563 | −1.2719 | 45.33 |
| 0.1473 | 0.0769 | 45.33 |
| 0.1011 | 0.0882 | 45.33 |
| 0.0552 | 0.1007 | 45.33 |
| 2.8234 | −1.3749 | 45.33 |
| 0.4216 | −0.2219 | 45.33 |
| 0.5972 | −0.2948 | 45.33 |
| 2.988 | −1.4821 | 45.33 |
| 0.0366 | 0.1046 | 45.33 |

TABLE 1-continued

The coordinate values given below provide the preferred nominal profile envelope information regarding the XYZ coordinates which are optimized for the 1st stage nozzle of a 7FB integrated gasification combined cycle (IGCC) gas turbine by the General Electric Company.

| X | Y | Z |
|---|---|---|
| 0.0177 | 0.1038 | 45.33 |
| −0.0274 | 0.0117 | 45.33 |
| 0.0001 | 0.097 | 45.33 |
| −0.0192 | −0.0054 | 45.33 |
| 2.4148 | −0.5211 | 45.33 |
| −0.014 | 0.0844 | 45.33 |
| 0.9487 | −0.44 | 45.33 |
| 3.1493 | −1.5941 | 45.33 |
| −0.0228 | 0.0677 | 45.33 |
| −0.0071 | −0.02 | 45.33 |
| 0.0726 | −0.071 | 45.33 |
| 0.3315 | 0.0299 | 45.33 |
| 0.0174 | −0.04 | 45.33 |
| 0.0444 | −0.0565 | 45.33 |
| 6.0157 | −2.1037 | 45.85 |
| 5.9531 | −2.0317 | 45.85 |
| 4.3367 | −3.1058 | 45.85 |
| 6.1219 | −3.34 | 45.85 |
| 5.3694 | −4.2133 | 45.85 |
| 5.422 | −4.1787 | 45.85 |
| 4.3806 | −3.236 | 45.85 |
| 5.4716 | −4.1396 | 45.85 |
| 5.5184 | −4.0974 | 45.85 |
| 5.5634 | −4.0533 | 45.85 |
| 5.8864 | −1.9637 | 45.85 |
| 4.4226 | −3.3667 | 45.85 |
| 5.6429 | −3.9709 | 45.85 |
| 4.465 | −3.4974 | 45.85 |
| 5.7213 | −3.8875 | 45.85 |
| 4.5104 | −3.627 | 45.85 |
| 4.5366 | −3.6951 | 45.85 |
| 5.8161 | −1.8993 | 45.85 |
| 4.6259 | −3.895 | 45.85 |
| 4.5943 | −3.8291 | 45.85 |
| 5.7427 | −1.8382 | 45.85 |
| 4.6596 | −3.9598 | 45.85 |
| 4.6964 | −4.0228 | 45.85 |
| 4.738 | −4.0827 | 45.85 |
| 6.1703 | −3.2383 | 45.85 |
| 4.7709 | −4.1219 | 45.85 |
| 6.2009 | −3.1622 | 45.85 |
| 6.2271 | −3.0846 | 45.85 |
| 4.8071 | −4.1579 | 45.85 |
| 6.248 | −3.0057 | 45.85 |
| 5.798 | −3.8026 | 45.85 |
| 6.2632 | −2.9256 | 45.85 |
| 5.8718 | −3.7152 | 45.85 |
| 4.8466 | −4.19 | 45.85 |
| 6.272 | −2.8446 | 45.85 |
| 4.8893 | −4.2178 | 45.85 |
| 6.274 | −2.763 | 45.85 |
| 4.9349 | −4.2409 | 45.85 |
| 4.9827 | −4.259 | 45.85 |
| 5.9421 | −3.6249 | 45.85 |
| 6.2693 | −2.6814 | 45.85 |
| 6.2589 | −2.6072 | 45.85 |
| 6.2429 | −2.5341 | 45.85 |
| 6.2213 | −2.4624 | 45.85 |
| 6.007 | −3.5332 | 45.85 |
| 5.0321 | −4.2721 | 45.85 |
| 4.5645 | −3.7625 | 45.85 |
| 5.0825 | −4.2798 | 45.85 |
| 5.1335 | −4.2817 | 45.85 |
| 5.1844 | −4.278 | 45.85 |
| 6.0672 | −3.4383 | 45.85 |
| 6.1942 | −2.3926 | 45.85 |
| 6.1622 | −2.325 | 45.85 |
| 5.233 | −4.2691 | 45.85 |
| 5.2804 | −4.2552 | 45.85 |
| 6.1257 | −2.2596 | 45.85 |
| 5.3259 | −4.2364 | 45.85 |

TABLE 1-continued

The coordinate values given below provide the preferred nominal profile envelope information regarding the XYZ coordinates which are optimized for the 1st stage nozzle of a 7FB integrated gasification combined cycle (IGCC) gas turbine by the General Electric Company.

| X | Y | Z |
|---|---|---|
| 6.0735 | −2.1797 | 45.85 |
| 4.9718 | −1.3867 | 45.85 |
| 4.0511 | −2.5086 | 45.85 |
| 4.8333 | −1.326 | 45.85 |
| 4.117 | −2.6158 | 45.85 |
| 4.6937 | −1.2682 | 45.85 |
| 4.5531 | −1.2128 | 45.85 |
| 4.2848 | −1.1137 | 45.85 |
| 4.0144 | −1.0202 | 45.85 |
| 5.244 | −1.5188 | 45.85 |
| 5.6482 | −1.7665 | 45.85 |
| 5.5507 | −1.699 | 45.85 |
| 5.4506 | −1.6355 | 45.85 |
| 3.286 | −1.7146 | 45.85 |
| 3.4041 | −1.8087 | 45.85 |
| 3.519 | −1.9067 | 45.85 |
| 5.3483 | −1.5755 | 45.85 |
| 3.737 | −2.1158 | 45.85 |
| 3.8221 | −2.2085 | 45.85 |
| 3.9032 | −2.3048 | 45.85 |
| 5.1089 | −1.4508 | 45.85 |
| 4.1771 | −2.7263 | 45.85 |
| 3.6301 | −2.009 | 45.85 |
| 3.9797 | −2.4048 | 45.85 |
| 4.236 | −2.8503 | 45.85 |
| 4.2889 | −2.977 | 45.85 |
| −0.0278 | 0.0497 | 45.85 |
| −0.0301 | 0.0307 | 45.85 |
| 0.0007 | 0.0975 | 45.85 |
| −0.0136 | 0.085 | 45.85 |
| 3.7426 | −0.9307 | 45.85 |
| −0.0226 | 0.0682 | 45.85 |
| −0.0275 | 0.0118 | 45.85 |
| 3.4698 | −0.8444 | 45.85 |
| −0.0193 | −0.0054 | 45.85 |
| −0.0071 | −0.0201 | 45.85 |
| 3.1962 | −0.7607 | 45.85 |
| 0.0177 | −0.0402 | 45.85 |
| 2.922 | −0.679 | 45.85 |
| 0.0449 | −0.0569 | 45.85 |
| 2.4311 | −0.5375 | 45.85 |
| 1.7713 | −0.8113 | 45.85 |
| 2.0003 | −0.9242 | 45.85 |
| 2.2266 | −1.0427 | 45.85 |
| 2.4498 | −1.1669 | 45.85 |
| 2.6698 | −1.2968 | 45.85 |
| 2.8377 | −1.4015 | 45.85 |
| 3.003 | −1.5104 | 45.85 |
| 1.9388 | −0.4007 | 45.85 |
| 1.4456 | −0.2668 | 45.85 |
| 3.165 | −1.6241 | 45.85 |
| 0.7051 | −0.0694 | 45.85 |
| 0.3344 | 0.0277 | 45.85 |
| −0.0226 | 0.0682 | 45.85 |
| 0.149 | 0.0761 | 45.85 |
| 0.0732 | −0.0716 | 45.85 |
| 0.1025 | 0.0878 | 45.85 |
| 0.1897 | −0.1241 | 45.85 |
| 0.1314 | −0.0981 | 45.85 |
| 0.2482 | −0.1498 | 45.85 |
| 0.0563 | 0.1007 | 45.85 |
| 0.4242 | −0.2255 | 45.85 |
| 0.6007 | −0.3 | 45.85 |
| 0.954 | −0.4484 | 45.85 |
| 0.0376 | 0.1047 | 45.85 |
| 1.3063 | −0.5993 | 45.85 |
| 0.0186 | 0.1042 | 45.85 |
| 1.5398 | −0.7033 | 45.85 |
| 5.3633 | −4.2897 | 46.37 |
| 4.5407 | −3.6726 | 46.37 |
| 4.5673 | −3.7411 | 46.37 |

TABLE 1-continued

The coordinate values given below provide the preferred nominal profile envelope information regarding the XYZ coordinates which are optimized for the 1st stage nozzle of a 7FB integrated gasification combined cycle (IGCC) gas turbine by the General Electric Company.

| X | Y | Z |
|---|---|---|
| 5.924 | −2.0012 | 46.37 |
| 6.1123 | −2.219 | 46.37 |
| 5.6035 | −4.1063 | 46.37 |
| 4.7301 | −4.0706 | 46.37 |
| 5.6838 | −4.0236 | 46.37 |
| 4.9236 | −4.268 | 46.37 |
| 6.1344 | −3.4481 | 46.37 |
| 5.1692 | −4.334 | 46.37 |
| 5.2696 | −4.322 | 46.37 |
| 6.3153 | −2.8883 | 46.37 |
| 6.2619 | −2.5035 | 46.37 |
| 6.0385 | −3.6018 | 46.37 |
| 6.0541 | −2.1424 | 46.37 |
| 4.6267 | −3.8756 | 46.37 |
| 4.9694 | −4.2915 | 46.37 |
| 5.1179 | −4.3317 | 46.37 |
| 5.2206 | −4.3306 | 46.37 |
| 5.0174 | −4.3101 | 46.37 |
| 6.3168 | −2.8061 | 46.37 |
| 5.4604 | −4.232 | 46.37 |
| 6.2019 | −2.3653 | 46.37 |
| 6.2456 | −3.2088 | 46.37 |
| 6.2344 | −2.4334 | 46.37 |
| 5.7631 | −3.9398 | 46.37 |
| 6.0881 | −3.526 | 46.37 |
| 4.4072 | −3.2795 | 46.37 |
| 6.2715 | −3.1305 | 46.37 |
| 6.2151 | −3.2855 | 46.37 |
| 4.7719 | −4.131 | 46.37 |
| 4.4945 | −3.5421 | 46.37 |
| 4.6591 | −3.9417 | 46.37 |
| 4.8807 | −4.2397 | 46.37 |
| 4.4508 | −3.4108 | 46.37 |
| 4.8411 | −4.2071 | 46.37 |
| 5.9911 | −2.0699 | 46.37 |
| 5.0671 | −4.3236 | 46.37 |
| 4.6932 | −4.007 | 46.37 |
| 6.284 | −2.5757 | 46.37 |
| 4.3126 | −3.0194 | 46.37 |
| 5.7796 | −1.8745 | 46.37 |
| 6.2921 | −3.0508 | 46.37 |
| 5.3174 | −4.3083 | 46.37 |
| 6.3114 | −2.724 | 46.37 |
| 6.3005 | −2.6493 | 46.37 |
| 5.558 | −4.1506 | 46.37 |
| 6.165 | −2.2995 | 46.37 |
| 5.9149 | −3.7663 | 46.37 |
| 5.5105 | −4.1928 | 46.37 |
| 4.8048 | −4.1706 | 46.37 |
| 5.8533 | −1.9362 | 46.37 |
| 6.1768 | −3.368 | 46.37 |
| 5.4073 | −4.2667 | 46.37 |
| 6.3069 | −2.97 | 46.37 |
| 5.9857 | −3.6754 | 46.37 |
| 4.3618 | −3.1488 | 46.37 |
| 5.8404 | −3.8543 | 46.37 |
| 4.596 | −3.8089 | 46.37 |
| 4.7244 | −1.297 | 46.37 |
| 5.5866 | −1.7336 | 46.37 |
| 3.9982 | −2.4444 | 46.37 |
| 4.3514 | −1.1546 | 46.37 |
| 4.5829 | −1.241 | 46.37 |
| 3.3005 | −1.7475 | 46.37 |
| 5.2782 | −1.551 | 46.37 |
| 3.8394 | −2.2466 | 46.37 |
| 3.7536 | −2.1531 | 46.37 |
| 5.6846 | −1.8019 | 46.37 |
| 4.1982 | −2.7676 | 46.37 |
| 3.5345 | −1.942 | 46.37 |
| 4.1372 | −2.6565 | 46.37 |
| 4.865 | −1.3556 | 46.37 |

TABLE 1-continued

The coordinate values given below provide the preferred nominal profile envelope information regarding the XYZ coordinates which are optimized for the 1st stage nozzle of a 7FB integrated gasification combined cycle (IGCC) gas turbine by the General Electric Company.

| X | Y | Z |
|---|---|---|
| 3.4191 | −1.8428 | 46.37 |
| 5.0044 | −1.4171 | 46.37 |
| 5.1423 | −1.482 | 46.37 |
| 5.486 | −1.6693 | 46.37 |
| 4.1184 | −1.0725 | 46.37 |
| 3.9211 | −2.3437 | 46.37 |
| 3.6462 | −2.0453 | 46.37 |
| 4.0704 | −2.5487 | 46.37 |
| 5.3831 | −1.6085 | 46.37 |
| 4.2584 | −2.8921 | 46.37 |
| 0.0014 | 0.0981 | 46.37 |
| −0.0224 | 0.0687 | 46.37 |
| 0.0386 | 0.1048 | 46.37 |
| 2.0101 | −0.9433 | 46.37 |
| −0.0069 | −0.0202 | 46.37 |
| 3.6493 | −0.9171 | 46.37 |
| 0.6039 | −0.3053 | 46.37 |
| 3.1791 | −1.6557 | 46.37 |
| 1.9514 | −0.4142 | 46.37 |
| −0.0278 | 0.0501 | 46.37 |
| 1.3129 | −0.6114 | 46.37 |
| 0.0738 | −0.0722 | 46.37 |
| 0.1039 | 0.0874 | 46.37 |
| 2.4613 | −1.1907 | 46.37 |
| 0.7101 | −0.0743 | 46.37 |
| 2.4468 | −0.5543 | 46.37 |
| 1.4552 | −0.277 | 46.37 |
| 0.0194 | 0.1046 | 46.37 |
| 0.0574 | 0.1006 | 46.37 |
| 0.2497 | −0.1518 | 46.37 |
| −0.0224 | 0.0687 | 46.37 |
| −0.0302 | 0.031 | 46.37 |
| 0.0453 | −0.0573 | 46.37 |
| 0.1506 | 0.0753 | 46.37 |
| 3.4137 | −0.8427 | 46.37 |
| 0.4265 | −0.2291 | 46.37 |
| 1.78 | −0.8279 | 46.37 |
| 3.8843 | −0.9935 | 46.37 |
| 2.9409 | −0.6987 | 46.37 |
| 2.2372 | −1.0641 | 46.37 |
| 0.3371 | 0.0255 | 46.37 |
| −0.0132 | 0.0856 | 46.37 |
| 2.6821 | −1.323 | 46.37 |
| 0.018 | −0.0405 | 46.37 |
| −0.0277 | 0.0119 | 46.37 |
| 3.1775 | −0.77 | 46.37 |
| 3.0165 | −1.5403 | 46.37 |
| −0.0193 | −0.0054 | 46.37 |
| 0.1322 | −0.0991 | 46.37 |
| 2.8506 | −1.4296 | 46.37 |
| 0.1909 | −0.1256 | 46.37 |
| 0.9589 | −0.457 | 46.37 |
| 1.5475 | −0.7176 | 46.37 |

It will also be appreciated that the airfoil disclosed in Table I may be scaled up or down geometrically for use in similar turbine designs. Consequently, the coordinate values set forth in Table I may be scaled upwardly or downwardly such that the airfoil section shape remains unchanged. A scaled version of the coordinates in Table I would be represented by X, Y and, optionally, Z coordinate values (after the Z values have been converted to inches) multiplied or divided by the same constant or number.

While the invention has been described in connection with what is presently considered to be the most practical and preferred embodiment, it is to be understood that the invention is not to be limited to the disclosed embodiment. On the contrary, is intended to cover various modifications and equivalent arrangements included within the spirit and scope of the appended claims.

What is claimed is:

1. A turbine nozzle having an airfoil shape in an envelope within±0.160 inches in a direction normal to any airfoil surface location wherein the airfoil has a nominal profile substantially in accordance with Cartesian coordinate values of X, Y and Z set forth in Table I, X and Y being distances in inches defining the airfoil profile at each distance Z, the profiles at the Z distances being joined smoothly with one another to form a complete airfoil shape.

2. The turbine nozzle according to claim 1, wherein the turbine nozzle comprises a first stage nozzle of a turbine.

3. The turbine nozzle according to claim 1, wherein the Z value is measured from an intersection of a centerline of the nozzle along a radius from an axis of a turbine and a root radius of a flow path through the turbine.

4. A turbine nozzle having an uncoated nominal airfoil profile substantially in accordance with Cartesian coordinate values of X, Y and Z set forth in Table I, Z being a non-dimensional value along a nozzle stacking axis coincident with a radius from a turbine axis of rotation and a Z distance in inches from said turbine axis, X and Y are distances in inches defining the airfoil profile at each distance Z, the profiles at the Z distances being joined smoothly with one another to form a complete airfoil shape.

5. The turbine nozzle according to claim 4, wherein X and Y are distances being scalable as a function of the same constant or number to provide a scaled-up or scaled-down nozzle airfoil.

6. The turbine nozzle according to claim 5 comprising a first stage nozzle of a turbine.

7. The turbine nozzle according to claim 4, wherein Z is a distance being scalable as a function of the same constant or number to provide a scaled-up or scaled-down nozzle airfoil.

8. A turbine comprising a nozzle arrangement having a plurality of nozzles, each nozzle including an airfoil having an uncoated nominal airfoil profile substantially in accordance with Cartesian coordinate values of X, Y, and Z set forth in Table I, wherein X and Y are distances in inches which, when connected by smooth continuing arcs, define airfoil profile sections at each distance Z in inches, the profile sections at the Z distance being joined smoothly with one another to form a complete airfoil shape.

9. The turbine according to claim 8, wherein said airfoil shape lies in an envelope within±0.160 inches in a direction normal to any airfoil surface location.

10. The turbine according to claim 9, wherein the nozzle arrangement comprises a first stage nozzle of the turbine.

11. The turbine according to claim 10, wherein the first stage nozzle comprises 48 nozzles and Y represents a distance parallel to an axis of rotation of the turbine.

12. The turbine according to claim 8, wherein the nominal profile for said airfoil comprises an uncoated nominal profile, said X and Y distances being scalable as a function of the same constant or number.

13. The turbine according to claim 12, wherein the nozzle arrangement comprises a first stage nozzle of the turbine.

14. The turbine according to claim 13, wherein the first stage nozzle comprises 48 nozzles and Y represents a distance parallel to an axis of rotation of the turbine.

15. The turbine according to claim 8, wherein said Z distance being scalable as a function of the same constant or number.

* * * * *